US011670307B2

(12) United States Patent
Borss et al.

(10) Patent No.: US 11,670,307 B2
(45) **Date of Patent: *Jun. 6, 2023**

(54) DOWNMIXER AND METHOD FOR DOWNMIXING AT LEAST TWO CHANNELS AND MULTICHANNEL ENCODER AND MULTICHANNEL DECODER

(71) Applicant: FRAUNHOFER-GESELLSCHAFT ZUR FOERDERUNG DER ANGEWANDTEN FORSCHUNG E.V., Munich (DE)

(72) Inventors: Christian Borss, Erlangen (DE); Bernd Edler, Fuerth (DE); Guillaume Fuchs, Bubenreuth (DE); Jan Buethe, Erlangen (DE); Sascha Disch, Fuerth (DE); Florin Ghido, Nuremberg (DE); Stefan Bayer, Nuremberg (DE); Markus Multrus, Nuremberg (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/501,356

(22) Filed: Oct. 14, 2021

(65) Prior Publication Data

US 2022/0068284 A1 Mar. 3, 2022

Related U.S. Application Data

(63) Continuation of application No. 16/847,403, filed on Apr. 13, 2020, now Pat. No. 11,183,196, which is a (Continued)

(30) Foreign Application Priority Data

Nov. 8, 2016 (DE) ..... 16197813.5

(51) Int. Cl.
*G10L 19/008* (2013.01)
*H04S 3/00* (2006.01)

(52) U.S. Cl.
CPC ..... *G10L 19/008* (2013.01); *H04S 3/008* (2013.01); *H04S 2400/01* (2013.01); *H04S 2400/03* (2013.01)

(58) Field of Classification Search
CPC ... G10L 19/008; H04S 3/008; H04S 2400/01; H04S 2400/03
See application file for complete search history.

(56) References Cited

U.S. PATENT DOCUMENTS 7,848,932 B2 12/2010 Goto et al.
2005/0074127 A1 4/2005 Herre et al.
(Continued)

FOREIGN PATENT DOCUMENTS

CN 102257563 A 11/2011
CN 105765652 A 7/2016
(Continued)

OTHER PUBLICATIONS

Samsudin, E., et al. "A Stereo to Mono Dowmixing Scheme for MPEG-4 Parametric Stereo Encoder." 2006 IEEE International Conference on Acoustics Speech and Signal Processing Proceedings. vol. 5. IEEE, 2006.
(Continued)

*Primary Examiner* — David L Ton
(74) *Attorney, Agent, or Firm* — Perry + Currier

(57) ABSTRACT

A downmixer for downmixing at least two channels of a multichannel signal having the two or more channels includes: a processor for calculating a partial downmix signal from the at least two channels; a complementary signal calculator for calculating a complementary signal from the multichannel signal, the complementary signal
(Continued)

being different from the partial downmix signal; and an adder for adding the partial downmix signal and the complementary signal to obtain a downmix signal of the multichannel signal.

17 Claims, 16 Drawing Sheets

Related U.S. Application Data continuation of application No. 16/395,933, filed on Apr. 26, 2019, now Pat. No. 10,665,246, which is a continuation of application No. PCT/EP2017/077820, filed on Oct. 30, 2017.

(56) References Cited

U.S. PATENT DOCUMENTS

| | | | |
|---|---|---|---|
| 2006/0009225 | A1 | 1/2006 | Herre et al. |
| 2006/0190247 | A1 | 8/2006 | Lindblom |
| 2006/0206323 | A1 | 9/2006 | Breebaart |
| 2009/0125313 | A1 | 5/2009 | Hellmuth et al. |
| 2011/0096932 | A1 | 4/2011 | Schuijers |
| 2011/0173005 | A1 | 7/2011 | Hilpert et al. |
| 2011/0255714 | A1 | 10/2011 | Neusinger et al. |
| 2012/0224702 | A1 | 9/2012 | Den Brinker et al. |
| 2012/0265542 | A1 | 10/2012 | Kovesi et al. |
| 2013/0028426 | A1 | 1/2013 | Purnhagen et al. |
| 2013/0173274 | A1 | 7/2013 | Kuntz et al. |
| 2013/0262130 | A1 | 10/2013 | Ragot et al. |
| 2014/0074489 | A1 | 3/2014 | Chong et al. |
| 2015/0213790 | A1 | 7/2015 | Oh |
| 2016/0133262 | A1 | 5/2016 | Fueg et al. |
| 2016/0212561 | A1 | 7/2016 | Adami et al. |
| 2018/0233154 | A1 | 8/2018 | Vaillancourt et al. |
| 2019/0392844 | A1 | 12/2019 | Purnhagen et al. |

FOREIGN PATENT DOCUMENTS

| | | | |
|---|---|---|---|
| EP | 2854133 | A1 | 4/2015 |
| JP | 2005533426 | A | 11/2005 |
| JP | 2007531913 | A | 11/2007 |
| JP | 2010521002 | A | 6/2010 |
| JP | 2011209588 | A | 10/2011 |
| JP | 2016538578 | A | 12/2016 |
| KR | 20120006010 | A | 1/2012 |
| RU | 2452043 | C2 | 5/2012 |
| RU | 2573774 | C2 | 1/2016 |
| WO | WO-2004008805 | A1 | 1/2004 |
| WO | WO-2008039038 | A1 | 4/2008 |
| WO | WO-2009039897 | A1 | 4/2009 |
| WO | WO-2011128138 | A1 | 10/2011 |
| WO | WO-2014161996 | A2 | 10/2014 |
| WO | WO-2015043891 | A1 | 4/2015 |

OTHER PUBLICATIONS

Vilkamo, Juha, Achim Kuntz, and Simone Füg. "Reduction of spectral artifacts in multichannel downmixing with adaptive phase alignment." Journal of the Audio Engineering Society 62.7/8 (2014): 516-526.

IPEA/EP, International Preliminary Report on Patentability, dated Nov. 29, 2018, re PCT International Patent Application No. PCT/EP2017/077820.

ISA/EP, International Search Report and Written Opinion, dated Jan. 18, 2018, re PCT International Patent Application No. PCT/EP2017/077820.

TWIPO, Examination Report, dated Jul. 17, 2018 (received on Jul. 20, 2018), re Taiwan Patent Application No. 106138444.

Adami, Alexander, Emanuël AP Habets, and Jürgen Herre. "Downmixing using coherence suppression." 2014 IEEE International Conference on Acoustics, Speech and Signal Processing (ICASSP). IEEE, 2014.

Wu, Wenhai, et al. "Parametric stereo coding scheme with a new downmix method and whole band inter channel time/phase differences." 2013 IEEE International Conference on Acoustics, Speech and Signal Processing. IEEE, 2013.

RUPTO, Official Action with English translation, dated Jan. 31, 2020 re Russian Patent Application No. 2019116605.

USPTO, Notice of Allowance and Fees Due, dated Jan. 14, 2020 re U.S. Appl. No. 16/395,933.

CIPO, Examination Report, dated Mar. 3, 2020 re Canadian Patent Application No. 3045847.

Kim, JungHoe et al. "Enhanced stereo coding with phase parameters for MPEG unified speech and audio coding." Audio Engineering Society Convention 127. Audio Engineering Society, 2009.

ISO/IEC FDIS 23003-3:2011(E), Information technology—MPEG audio technologies—Part 3: Unified speech and audio coding. ISO/IEC JTC 1/SC 29/WG 11. Sep. 20, 2011.

Hoang, Thi Minh Nguyet, et al. "Parametric stereo extension of ITU-T G. 722 based on a new downmixing scheme." 2010 IEEE International Workshop on Multimedia Signal Processing. IEEE, 2010.

Fatus, Bertrand, Parametric Coding for Spatial Audio. Master's Thesis, KTH, Stockholm, Sweden, Jul.-Dec. 2015.

singularity point of the sum-component L[k] + R[k] at ILD = 0 dB and IPD = pi $$M[k] = W[k](L[k] + R[k])$$

where $$W[k] = \sqrt{\frac{|L[k]|^2 + |R[k]|^2}{2|L[k] + R[k]|^2}}$$

energy relation of the new downmixing for the embodiment $$M[k, n] = W_1[k, n](L[k, n] + R[k, n]) + W_2[k, n]L[k, n]$$

where $$W_1[k, n] = \frac{\sqrt{|L[k, n]|^2 + |R[k, n]|^2}}{\sqrt{2}(|L[k, n]| + |R[k, n]|)}$$

$$W_2[k, n] = \left(1 - \frac{|L[k, n] + R[k, n]|}{|L[k, n]| + |R[k, n]|}\right)$$

given that $$|L[k, n] + R[k, n]| \leq |L[k, n]| + |R[k, n]|,$$

$W_1[k, n]$ and $W_2[k, n]$ are always positive and $W_1[k, n]$ is limited to 0.5.

Fig. 8b $$W_1[b, n] = \frac{\sqrt{\sum_{k \in b}|L[k, n]|^2 + \sum_{k \in b}|R[k, n]|^2}}{\sqrt{2}(\sum_{k \in b}|L[k, n]| + \sum_{k \in b}|R[k, n]|)}$$

$$W_2[b, n] = \left(1 - \frac{\sum_{k \in b}|L[k, n] + R[k, n]|}{\sum_{k \in b}|L[k, n]| + \sum_{k \in b}|R[k, n]|}\right)$$

Fig. 8c for every condition, the phase of the downmixed signal evolved steadily and continuously gain limitation of the sum signal in the new down-mixing of a further embodiment $$M[k, n] = W_1[k, n](L[k, n] + R[k, n]) + W_2[k, n](L[k, n] - R[k, n])$$

$$x = \frac{1}{\sqrt{2}}\left(\frac{\sqrt{|L[k,n]|^2 + |R[k,n]|^2}}{|L+R|^2}\right)$$

$$W_1 = \begin{cases} x & \text{if } x \le \frac{1}{\sqrt{2}} \\ \frac{1}{\sqrt{2}} + \left(1 - \frac{1}{\sqrt{2}}\right)\left(1 - \exp\left(\frac{\frac{1}{\sqrt{2}} - x}{1 - \frac{1}{\sqrt{2}}}\right)\right) & \text{if } x > \frac{1}{\sqrt{2}} \end{cases}$$

Fig. 9c $$E_M = |M|^2 = |W_1(L+R) + W_2 L|^2 = \frac{L^2 + R^2}{2}$$

the roots of the equation are given by:

$$W_2 = -p \pm \sqrt{p^2 - q}$$

, where $$p = \frac{< W_1(L+R), L-R >}{|L-R|^2} = \left(\frac{W_1(|L|^2 - |R|^2)}{|L-R|^2}\right)$$

$$q = \frac{(W_1|L+R|)^2 - \frac{|L|^2 - |R|^2}{2}}{|L-R|^2}$$

Fig. 9d energy relation of the new downmixing gain $W_2$ in function of ILD and IPD energy relation of the new downmixing $$M = W_1[k](L[k] + R[k]) + W_2[k](L[k] - R[k])$$

$$x = \frac{1}{\sqrt{2}}\left(\frac{\sqrt{|L[k,n]|^2 + |R[k,n]|^2}}{(L+R)^2}\right)$$

$$W_1 = \begin{cases} x & \text{if } x \le \frac{1}{\sqrt{2}} \\ \frac{1}{\sqrt{2}} + \left(1 - \frac{1}{\sqrt{2}}\right)\left(1 - \exp\left(\frac{\frac{1}{\sqrt{2}} - x}{1 - \frac{1}{\sqrt{2}}}\right)\right) & \text{if } x > \frac{1}{\sqrt{2}} \end{cases}$$

$$E_M = |M|^2 = |W_1(L+R) + W_2 L|^2 = \left(\frac{|L| + |R|}{2}\right)^2$$

Fig. 10b $$W_2 = -|p| + \sqrt{p^2 - q}$$

Fig. 10c $$p = \frac{< W_1(L+R), L-R >}{|L-R|^2} = \left(\frac{W_1(|L|^2 - |R|^2)}{|L-R|^2}\right)$$

$$q = \frac{(W_1|L+R|)^2 - \left(\frac{|L| + |R|}{2}\right)^2}{|L-R|^2}$$

Fig. 10d energy relation of the new downmixing

DOWNMIXER AND METHOD FOR DOWNMIXING AT LEAST TWO CHANNELS AND MULTICHANNEL ENCODER AND MULTICHANNEL DECODER

CROSS-REFERENCES TO RELATED APPLICATIONS

This application is a continuation of U.S. application Ser. No. 16/847,403, filed Apr. 13, 2020, which is a continuation of a U.S. application Ser. No. 16/395,933, filed Apr. 26, 2019, now U.S. Pat. No. 10,665,246 issued May 26, 2020, which is a continuation of International Application No. PCT/EP2017/077820, filed Oct. 30, 2017, which is incorporated herein by reference in its entirety, and additionally claims priority from European Application No. EP 16197813.5, filed Nov. 8, 2016, which is incorporated herein by reference in its entirety.

The present invention is related to audio processing and, particularly, to the processing of multichannel audio signals comprising two or more audio channels.

BACKGROUND OF THE INVENTION

Reducing the number of channels is essential for achieving multichannel coding at low bit-rates. For example, parametric stereo coding schemes are based on an appropriate mono downmix from the left and right input channels. The so-obtained mono signal is to be encoded and transmitted by the mono codec along with side-information describing in a parametric form the auditory scene. The side information usually consists of several spatial parameters per frequency sub-band. They could include for example:

- Inter-channel Level Difference (ILD) measuring the level difference (or balance) between channels.
- Inter-channel Time Difference (ITD) or Inter-channel Phase Difference (IPD) describing the time or phase difference between channels, respectively.

However, a downmix processing is prone to create signal cancellation and coloration due to inter-channel phase misalignment, which leads to undesired quality degradations. As an example, if the channels are coherent and near out-of-phase, the downmix signal is likely to show perceivable spectral bias, such as the characteristics of a comb-filter.

The downmix operation can be performed in time domain simply by a sum of the left and right channels, as expressed by $$m[n]=w_1 l[n]+w_2 r[n].$$

where l[n] and r[n] are the left and right channels, n is the time index, and $w_1[n]$ and $w_2[n]$ are weights that determined the mixing. If the weights are constant over time, we speak about passive downmix. It has the disadvantage to be regardless of the input signal and the quality of the obtained downmix signal is highly dependent on input signal characteristics. Adapting the weight over time can reduce this problem to some extent.

However, for solving the main issues, an active downmix is usually performed in the frequency domain using for example a Short-Term Fourier Transform (STFT). Thereby the weights can be made dependent of the frequency index k and time index n and can fit better to the signal characteristics. The downmix signal is then expressed as:

$$M[k,n]=W_1[k,n]L[k,n]+W_2[k,n]R[k,n]$$

where M[k,n], L[k,n] and R[k,n] are the STFT components of the downmix signal, the left channel and the right channel, respectively, at frequency index k and time index n. The weights $W_1[k, n]$ and $W_2[k, n]$ can be adaptively adjusted in time and in frequency. It aims at preserving the average energy or amplitude of the two input channels by minimizing spectral bias caused by comb filtering effects.

The most straightforward method for active downmixing is to equalize the energy of the downmix signal to yield for each frequency bin or sub-band the average energy of the two input channels [1]. The downmix signal as shown in FIG. 7*b* can be then formulated as:

$$M[k]=W[k](L[k]+R[k])$$

where $$W[k]=\sqrt{\frac{|L[k]|^2+|R[k]|^2}{2|L[k]+R[k]|^2}}$$

Such straight forward solution has several shortcomings. First, the downmix signal is undefined when the two channels have phase inverted time-frequency components of equal amplitude (ILD=0 db and IPD=pi). This singularity results from the denominator becoming zero in this case. The output of a simple active downmixing is in this case unpredictable. This behavior is shown in FIG. 7*a* for various inter-channel level differences where the phase is plotted as a function of the IPD.

For ILD=0 dB, the sum of the two channels is discontinuous at IPD=pi resulting in a step of pi radian. In other conditions, the phase evolves regularly and continuously in modulo 2pi.

The second nature of problems comes from the important variance of the normalization gains for achieving such an energy-equalization. Indeed the normalization gains can fluctuate drastically from frame to frame and between adjacent frequency sub-bands. It leads to an unnatural coloration of the downmix signal and to block effects. The usage of synthesis windows for the STFT and the overlap-add method result in smoothed transitions between processed audio frames. However, a great change in the normalization gains between sequential frames can still lead to audible transition artefacts. Moreover, this drastic equalization can also leads to audible artefacts due to aliasing from the frequency response side lobes of the analysis window of the block transform.

As an alternative, the active downmix can be achieved by performing a phase alignment of the two channels before computing the sum-signal [2-4]. The energy-equalization to be done on the new sum signal is then limited, since the two channels are already in-phase before summing them up. In [2], the phase of the left channel is used as reference for aligning the two channels in phase. If the phases of the left channels are not well conditioned (e.g. zero or low-level noise channel), the downmix signal is directly affected. In [3], this important issue is solved by taking as reference the phase of the sum signal before rotation.

Still the singularity problem at ILD=0 dB and IPD=pi is not treated. For this reason, [4] amends the approach by using a broadband phase difference parameter in order to improve stability in such a case. Nonetheless, none of these approaches considered the second nature of problem related to the instability. The phase rotation of the channels can also lead to an unnatural mixing of the input channels and can create severe instabilities and block effects especially when great changes happen in the processing over time and frequency.

Finally, there are more evolved techniques like [5] and [6], which are based on the obser-vations that the signal cancellation during downmixing occurs only on time-frequency components which are coherent between the two channels. In [5], the coherent components are filtered out before summing-up incoherent parts of the input channels. In [6], the phase alignment is only computed for the coherent components before summing up the channels.

Moreover, the phase alignment is regularized over time and frequency for avoiding problems of stability and discontinuity. Both techniques are computationally demanding since in [5] filter coefficients need to be identified at every frame and in [6] a covariance matrix between the channels has to be computed.

SUMMARY

According to an embodiment, a downmixer for downmixing at least two channels of a multichannel signal having the two or more channels may have: a processor for calculating a partial downmix signal from the at least two channels; a complementary signal calculator for calculating a complementary signal from the multichannel signal, the complementary signal being different from the partial downmix signal; and an adder for adding the partial downmix signal and the complementary signal to obtain a downmix signal of the multichannel signal.

According to another embodiment, a method for downmixing at least two channels of a multichannel signal having the two or more channels may have the steps of: calculating a partial downmix signal from the at least two channels; calculating a complementary signal from the multichannel signal, the complementary signal being different from the partial downmix signal; and adding the partial downmix signal and the complementary signal to obtain a downmix signal of the multichannel signal.

According to another embodiment, a multichannel encoder may have: a parameter calculator for calculating multichannel parameters from at least two channels of a multichannel signal having the two or more than two channels, and an inventive downmixer; and an output interface for outputting or storing an encoded multichannel signal including the one or more downmix channels and/or the multichannel parameters.

According to another embodiment, a method for encoding a multichannel signal may have the steps of: calculating multichannel parameters from at least two channels of a multichannel signal having the two or more than two channels; and inventive downmixing; and outputting or storing an encoded multichannel signal including the one or more downmix channels and the multichannel parameters.

According to another embodiment, an audio processing system may have: an inventive multichannel encoder for generating an encoded multichannel signal; and a multichannel decoder for decoding the encoded multichannel signal to obtain a reconstructed audio signal.

According to another embodiment, a method of processing an audio signal may have the steps of: inventive multichannel encoding; and multichannel decoding an encoded multichannel signal to obtain a reconstructed audio signal.

Another embodiment may have a non-transitory digital storage medium having a computer program stored thereon to perform the method for downmixing at least two channels of a multichannel signal having the two or more channels, including: calculating a partial downmix signal from the at least two channels; calculating a complementary signal from the multichannel signal, the complementary signal being different from the partial downmix signal; and adding the partial downmix signal and the complementary signal to obtain a downmix signal of the multichannel signal, when said computer program is run by a computer.

Another embodiment may have a non-transitory digital storage medium having a computer program stored thereon to perform the method for encoding a multichannel signal, including: calculating multichannel parameters from at least two channels of a multichannel signal having the two or more than two channels; and inventive downmixing; and outputting or storing an encoded multichannel signal including the one or more downmix channels and the multichannel parameters, when said computer program is run by a computer.

Another embodiment may have a non-transitory digital storage medium having a computer program stored thereon to perform the method of processing an audio signal, including: Inventive multichannel encoding; and multichannel decoding an encoded multichannel signal to obtain a reconstructed audio signal, when said computer program is run by a computer.

The present invention is based on the finding that a downmixer for downmixing at least two channel of a multichannel signal having the two or more channels not only performs an addition of the at least two channels for calculating a downmix signal from the at least two channels, but the downmixer additionally comprises a complementary signal calculator for calculating a complementary signal from the multichannel signal, wherein the complementary signal is different from the partial downmix signal. Furthermore, the downmixer comprises an adder for adding the partial downmix signal and the complementary signal to obtain a downmix signal of the multichannel signal. This procedure is advantageous, since the complementary signal, being different from the partial downmix signal fills any time domain or spectral domain holes within the downmix signal that may occur due to certain phase constellations of the at least two channels. Particularly, when the two channels are in phase, then typically no problem should occur when a straight-forward adding together of the two channels is performed. When, however, the two channels are out of phase, then the adding together of these two channels results in a signal with a very low energy even approaching zero energy. Due to the fact, however, that the complementary signal is now added to the partial downmix signal, the finally obtained downmix signal still has significant energy or at least does not show such serious energy fluctuations.

The present invention is advantageous, since it introduces a procedure for downmixing two or more channels aiming to minimize typical signal cancellation and instabilities observed in conventional downmixing.

Furthermore, embodiments are advantageous, since they represent a low complex procedure that has the potential to minimize usual problems from multichannel downmixing.

Advantageous embodiments rely on a controlled energy or amplitude-equalization of the sum signal mixed with the complementary signal that is also derived from the input signals, but is different from the partial downmix signal. The energy-equalization of the sum signal is controlled for avoiding problems at the singularity point, but also to minimize significant signal impairments due to large fluctuations of the gain. Advantageously, the complementary signal is there to compensate a remaining energy loss or to compensate at least a part of this remaining energy loss.

In an embodiment, the processor is configured to calculate the partial downmix signal so that the predefined energy related or amplitude related relation between the at least two channels and the partial downmix channel is fulfilled, when the at least two channels are in phase, and so that an energy loss is created in the partial downmix signal, when the at least two channels are out of phase. In this embodiment, the complementary signal calculator is configured to calculate the complementary signal so that the energy loss of the partial downmix signal is partly or fully compensated by adding the partial downmix signal and the complementary signal together.

In an embodiment, the complementary signal calculator is configured for calculating the complementary signal so that the complementary signal has a coherence index of 0.7 with respect to the partial downmix signal, where a coherence index of 0.0 shows a full incoherence and a coherence index of 1 shows a full coherence. Thus, it is made sure that the partial downmix signal on the one hand and the complementary signal on the other hand are sufficiently different from each other.

Advantageously, the downmixing generates the sum signal of the two channels such as L+R as it is done in conventional passive or active downmixing approaches. The gains applied to this sum signal that are subsequently called $W_1$ aim at equalizing the energy of the sum channel for either matching the average energy or the average amplitude of the input channels. However, in contrast to conventional active downmixing approaches, $W_1$ values are limited to avoid instability problems and to avoid that the energy relations are restored based on an impaired sum signal.

A second mixing is done with the complementary signal. The complementary signal is chosen such that its energy does not vanish when L and R are out-of-phase. The weighting factors $W_2$ compensate the energy equalization due to the limitation introduced into $W_1$ values.

BRIEF DESCRIPTION OF THE DRAWINGS

Embodiments of the present invention will be detailed subsequently referring to the appended drawings, in which:

FIG. 8*b* illustrates equations for the embodiment of FIG. 8*a;*

FIG. 8*c* illustrates alternative equations with a more coarse frequency resolution of the weighting factors;

FIG. 9*c* illustrates a manipulation function for calculating a manipulated weighting factor for the calculation of the sum signal of the embodiment of FIG. 9*a;*

FIG. 9*d* illustrates the calculations of the weighting factors for the calculation of the complementary signal $W_2$ for the embodiment of FIG. 9*a*-FIG. 9*c;*

FIG. 10*b* illustrates equations for the calculation of the downmix signal and the first weighting factor $W_1$ for the embodiment of FIG. 10*a;*

FIG. 10*c* illustrates procedures for calculating the second or complementary signal weighting factors for the embodiment of FIG. 10*a*-10*b;*

FIG. 10*d* illustrates equations for the parameters p and q of the FIG. 10*c* embodiment;

DETAILED DESCRIPTION OF THE INVENTION

Figure 1:
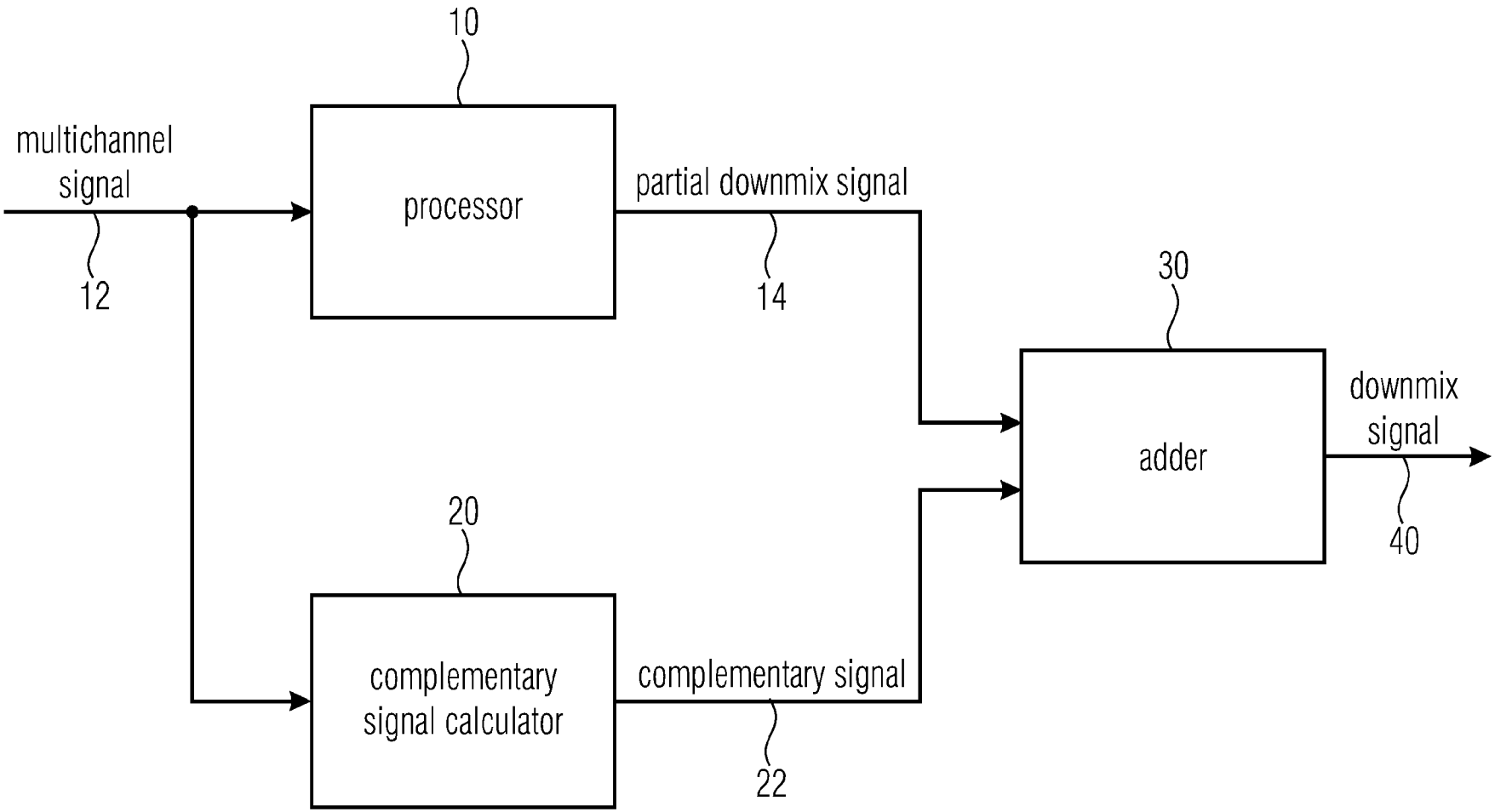
FIG. 1 is a block diagram of a downmixer in accordance with an embodiment.

FIG. 1 illustrates a downmixer for downmixing at least two channels of a multichannel signal 12 having the two or more channels. Particularly, the multichannel signal can only be a stereo signal with a left channel L and a right channel R, or the multichannel signal can have three or even more channels. The channels can also include or consist of audio objects. The downmixer comprises a processor 10 for calculating a partial downmix signal 14 from the at least two channels from the multichannel signal 12. Furthermore, the downmixer comprises a complementary signal calculator 20 for calculating a complementary signal from the multichannel signal 12, wherein the complementary signal 22 is output by block 20 is different from the partial downmix signal 14 output by block 10. Additionally, the downmixer comprises an adder 30 for adding the partial downmix signal and the complementary signal to obtain a downmix signal 40 of the multichannel signal 12. Generally, the downmix signal 40 has only a single channel or, alternatively, has more than one channel.

Generally, however, the downmix signal has fewer channels than are included in the multichannel signal 12. Thus, when the multichannel signal has, for example, five channels, the downmix signal may have four channels, three channels, two channels or a single channel.

The downmix signal with one or two channels is advantageous as compared to a downmix signal having more than two channels. In the case of a two channel signal as the multichannel signal 12, the downmix signal 40 only has a single channel.

In an embodiment, the processor 10 is configured to calculate the partial downmix signal 14 so that the predefined energy-related or amplitude-related relation between the at least two channels and the partial downmix signal is fulfilled, when the at least two channels are in phase and so that an energy loss is created in the partial downmix signal with respect to the at least two channels, when the at least two channels are out of phase. Embodiments and examples for the predefined relation are that the amplitudes of the downmix signal are in a certain relation to the amplitudes of the input signals or the subband-wise energies, for example, of the downmix signal are in a predefined relation to the energies of the input signals. One particularly interesting relation is that the energy of the downmix signal either over the full bandwidth or in subbands is equal to an average energy of the two downmix signals or the more than two downmix signals. Thus, the relation can be with respect to energy, or with respect to amplitude. Furthermore, the complementary signal calculator 20 of FIG. 1 is configured to calculate the complementary signal 22 so that the energy loss of the partial downmix signal as illustrated at 14 in FIG. 1 is partly or fully compensated by adding the partial downmix signal 14 and the complementary signal 22 in the adder 30 of FIG. 1 to obtain the downmix signal.

Generally, embodiments are based on the controlled energy or amplitude-equalization of the sum signal mixed with the complementary signal also derived from the input channels.

Embodiments are based on a controlled energy or amplitude-equalization of the sum signal mixed with a complementary signal also derived from the input channels. The energy-equalization of the sum signal is controlled for avoiding problems at the singularity point but also to minimize significantly signal impairments due to large fluctuations of the gain. The complementary signal is there to compensate the remaining energy loss or at least a part of it. The general form of the new downmix can be expressed as $$M[k,n]=W_1[k,n](L[k,n]+R[k,n])+W_2[k,n]S[k,n]$$

where the complementary signal S[k,n] are ideally orthogonal as much as possible to the sum signal, but can be in practice chosen as $$S[k,n]=L[k,n]$$

or $$S[k,n]=R[k,n]$$

or $$S[k,n]=L[k,n]-R[k,n].$$

In all cases, the downmixing generates first the sum channel L+R as it is done in conventional passive and active downmixing approaches. The gain $W_1$ [k, n] aims at equalizing the energy of the sum channel for either matching the average energy or the average amplitude of the input channels. However, unlike conventional active downmixing approaches, $W_1$[k, n] is limited to avoid instability problems and to avoid that the energy relations are restored based on an impaired sum signal.

A second mixing is done with the complementary signal. The complementary signal is chosen such that its energy doesn't vanish when L[k, n] and R[k, n] are out-of-phase. $W_2$[k, n] compensates the energy-equalization due to the limitation introduced in $W_1$[k, n].

As illustrated, the complementary signal calculator 20 is configured to calculate the complementary signal so that the complementary signal is different from the partial downmix signal. In quantities, it is advantageous that a coherence index of the complementary signal is less than 0.7 with respect to the partial downmix signal. In this scale, a coherence index of 0.0 shows a full incoherence and a coherence index of 1.0 shows a full coherence. Thus, a coherence index of less than 0.7 has proven to be useful so that the partial downmix signal and the complementary signal are sufficiently different from each other. However, coherence indices of less than 0.5 and even less than 0.3 are more advantageous.

Figure 2A:
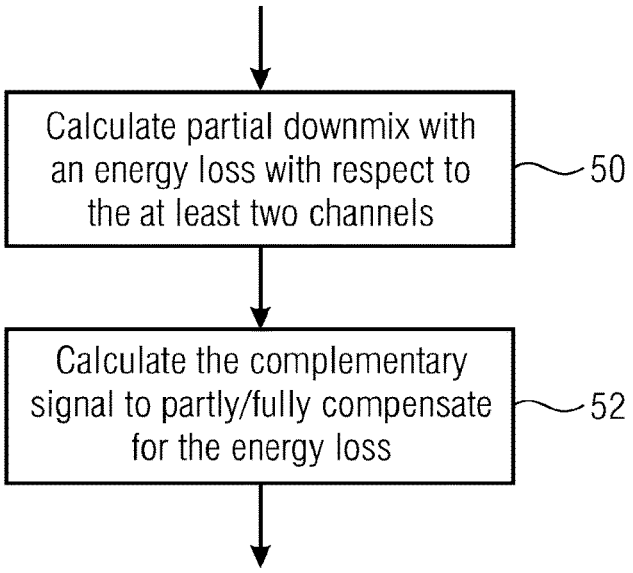
FIG. 2*a* is a flow chart for illustrating the energy loss compensation feature.

FIG. 2*a* illustrates a procedure performed by the processor. Particularly, as illustrated in item 50 of FIG. 2*a*, the processor calculates the partial downmix signal with an energy loss with respect the at least two channels that represent the input into the processor. Furthermore, the complementary signal calculator 52 calculates the complementary signal 22 of FIG. 1 to partly or fully compensate for the energy loss.

Figure 2B:
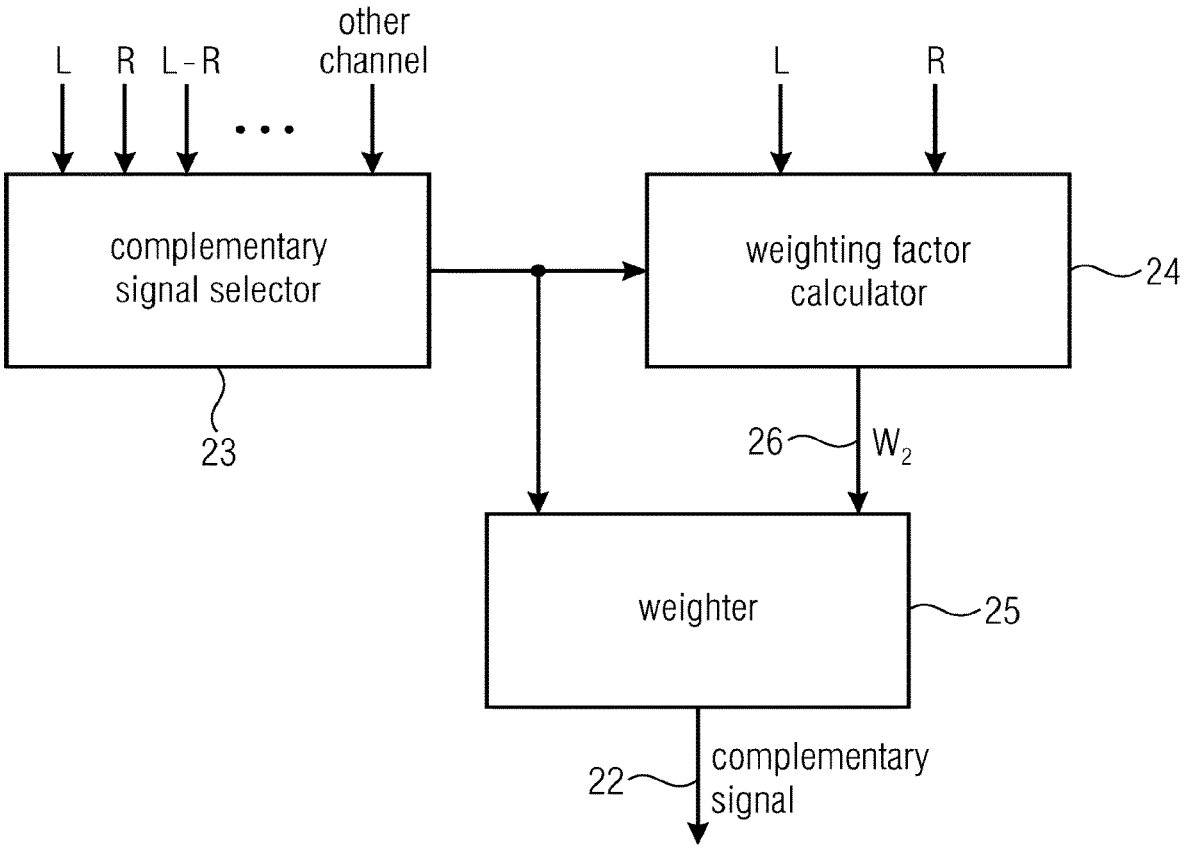
FIG. 2*b* is a block diagram illustrating an embodiment of the complementary signal calculator.

In an embodiment illustrated in FIG. 2*b*, the complementary signal calculator comprises a complementary signal selector or complementary signal determiner 23, a weighting factor calculator 24 and a weighter 25 to finally obtain the complementary signal 22. Particularly, the complementary signal selector or complementary signal determiner 23 is configured to use, for calculating the complementary signal, one signal of a group of signals consisting of a first channel such as L, a second channel such as R, a difference between the first channel and the second channel as indicated L-R in FIG. 2*b*. Alternatively, the difference can also be R-L. A further signal used by the complementary signal selector 23 can be a further channel of the multichannel signal, i.e., a channel that is not selected to be by the processor for calculating the partial downmix signal. This channel can, for example, be a center channel, or a surround channel or any other additional channel comprising an object. In other embodiments, the signal used by the complementary signal selector is a decorrelated first channel, a decorrelated second channel, a decorrelated further channel or even the decorrelated partial downmix signal as calculated by the processor 14. In advantageous embodiments, however, either the first channel such as L or the second channel such as R or, even more advantageously, the difference between the left channel and the right channel or the difference between the right channel and the left channel are advantageous for calculating the complementary signal.

The output of the complementary signal selector 23 is input into a weighting factor calculator 24. The weighting factor calculator additionally typically receives the two or more signals to be combined by the processor 10 and the weighting factor calculator calculates weights $W_2$ illustrated at 26. Those weights together with the signal used and determined by the complementary signal selector 23 are input into the weighter 25, and the weighter then weights the corresponding signal output from block 23 using the weighting factors from block 26 to finally obtain the complementary signal 22.

The weighting factors can only be time-dependent, so that for a certain block or frame in time, a single weighting factor $W_2$ is calculated. In other embodiments, however, it is advantageous to use time and frequency dependent weighting factors $W_2$ so that, for a certain block or frame of the complementary signal, not only a single weighting factor for this time block is available, but a set of weighting factors $W_2$ for a set of different frequency values or spectral bins of the signal generated or selected by block 23.

Figure 3:
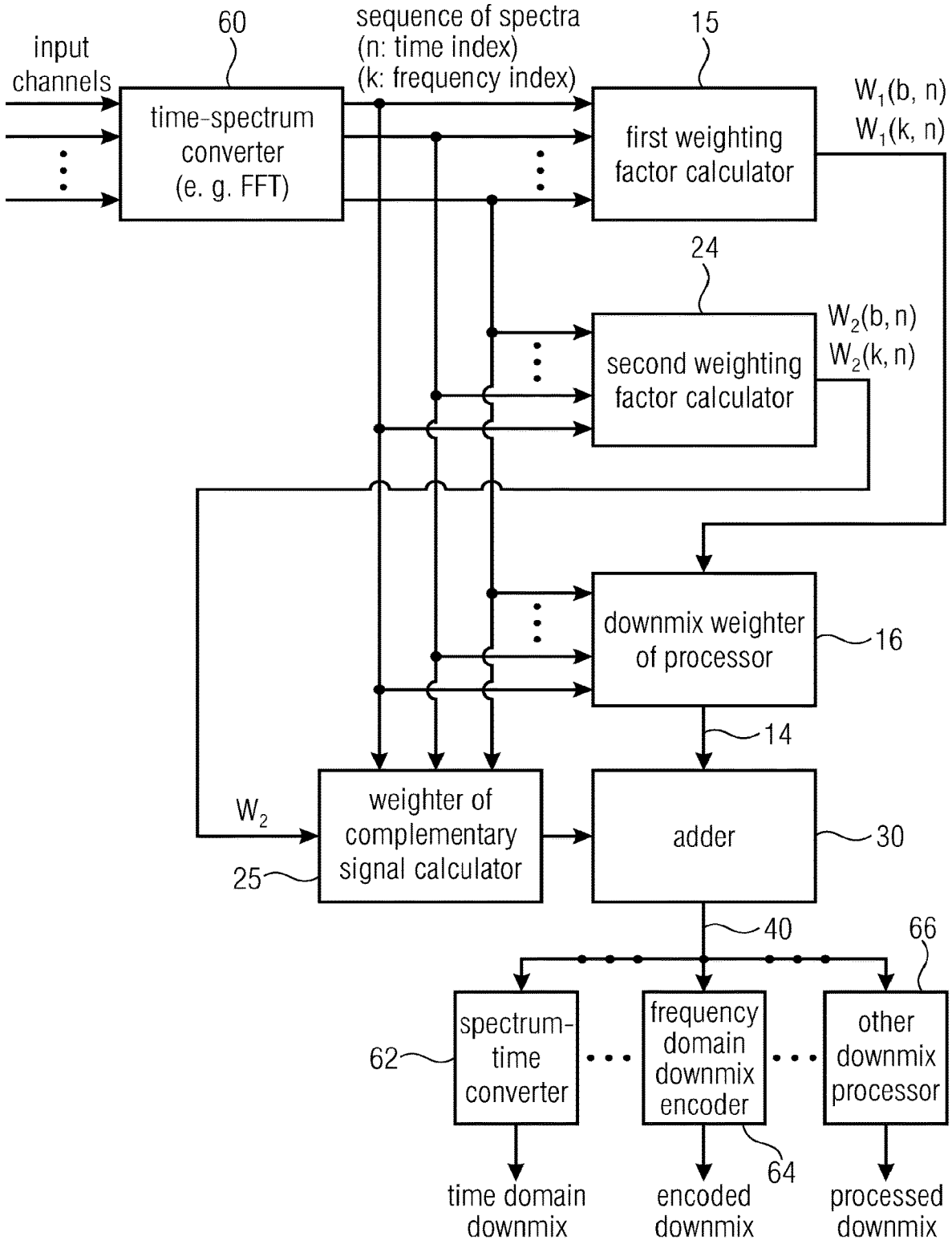
FIG. 3 is a schematic block diagram illustrating a downmixer operating in the spectral domain and having an adder output connected to different alternatives or cumulative processing elements.

A corresponding embodiment for time and frequency dependent weighting factors not only for usage of the complementary signal calculator 20, but also for usage of the processor 10 is illustrated in FIG. 3.

Particularly, FIG. 3 illustrates a downmixer in an advantageous embodiment that comprises a time-spectrum converted 60 for converting time domain input channels into frequency domain input channels, where each frequency domain input channel has a sequence of spectra. Each spectrum has a separate time index n and, within each spectrum, a certain frequency index k refers to a frequency component uniquely associated with the frequency index. Thus, in an example, when a block has 512 spectral values, then the frequency k runs from 0 to 511 in order to uniquely identify each one of the 512 different frequency indices.

The time-spectrum converter 60 is configured for applying an FFT and, advantageously, an overlapping FFT so that the sequence of spectra obtained by block 60 are related to overlapping blocks of the input channels. However, non-overlapping spectral conversion algo-rithms and other conversions apart from an FFT such as DCT or so can be used as well.

Particularly, the processor 10 of FIG. 1 comprises a first weighting factor calculator 15 for calculating weights $W_1$ for individual spectral indices k or weighting factors $W_1$ for sub-bands b, where a subband is broader than a spectral value with respect to frequency, and typically, comprises two or more spectral values.

The complementary signal calculator 20 of FIG. 1 comprises a second weighting factor calculator that calculates the weighting factors $W_2$. Thus, item 24 can be similarly constructed as item 24 of FIG. 2*b*.

Furthermore, the processor 10 of FIG. 1 calculating the partial downmix signal comprises a downmix weighter 16 that receives, as an input, the weighting factors $W_1$ and that outputs the partial downmix signal 14 that is forwarded to the adder 30. Furthermore, the embodiment illustrated in FIG. 3 additionally comprises the weighter 25 already described with respect FIG. 2*b* that receives, as an input, the second weighting factors $W_2$.

The adder 30 outputs the downmix signal 40. The downmix 40 can be used in several different occurrences. One way to use the downmix signal 40 is to input it into a frequency domain downmix encoder 64 illustrated in FIG. 3 that outputs an encoded downmix signal. An alternative procedure is to insert the frequency domain representation of the downmix signal 40 into a spectrum-time converter 62 in order to obtain, at the output of block 62, a time domain downmix signal. A further embodiment is to feed the downmix signal 40 into a further downmix processor 66 that generates some kind of process downmix channel such as a transmitted downmix channel, a stored downmix channel, or a downmix channel that has performed some kind of equalization, a gain variation etc.

In embodiments, the processor 10 is configured for calculating time or frequency-dependent weighting factors $W_1$ as illustrated by block 15 in FIG. 3 for a weighting a sum of the at least two channels in accordance with a predefined energy or amplitude relation between the at least two channels and a sum signal of the at least two channels. Furthermore, subsequent to this procedure that is also illustrated in item 70 of FIG. 4, the processor is configured to compare a calculated weighting factor $W_1$ for a certain frequency index k and a certain time index n or for a certain spectral subband b and a certain time index n to a predefined threshold as indicated at block 72 of FIG. 4. This comparison is performed advantageously for each spectral index k or for each subband index b or for each time index n and advantageously for one spectrum index k or b and for each time index n. When the calculated weighting factor is in a first relation to the predefined threshold such as below the threshold as illustrated at 73, then the calculated weighting factor $W_1$ is used as indicated at 74 in FIG. 4. When, however, the calculated weighting factor is in a second relation to the predefined threshold that is different from the first relation to the predefined threshold such as above the threshold as indicated at 75, the predefined threshold is used instead of the calculated weighting factor for calculating the partial downmix signal in block 16 of FIG. 3 for example. This is a "hard" limitation of $W_1$. In other embodiments, a kind of a "soft limitation" is performed. In this embodiment, a modified weighting factor is derived using a modification function, wherein the modification function is so that the modified weighting factor is closer to the predefined threshold then the calculated weighting factor.

The embodiment in FIG. 8*a*-8*d* uses a hard limitation, while the embodiment in FIG. 9*a*-9*f* and the embodiment in FIG. 10*a*-10*e* use a soft limitation, i.e., a modification function.

Figure 4:
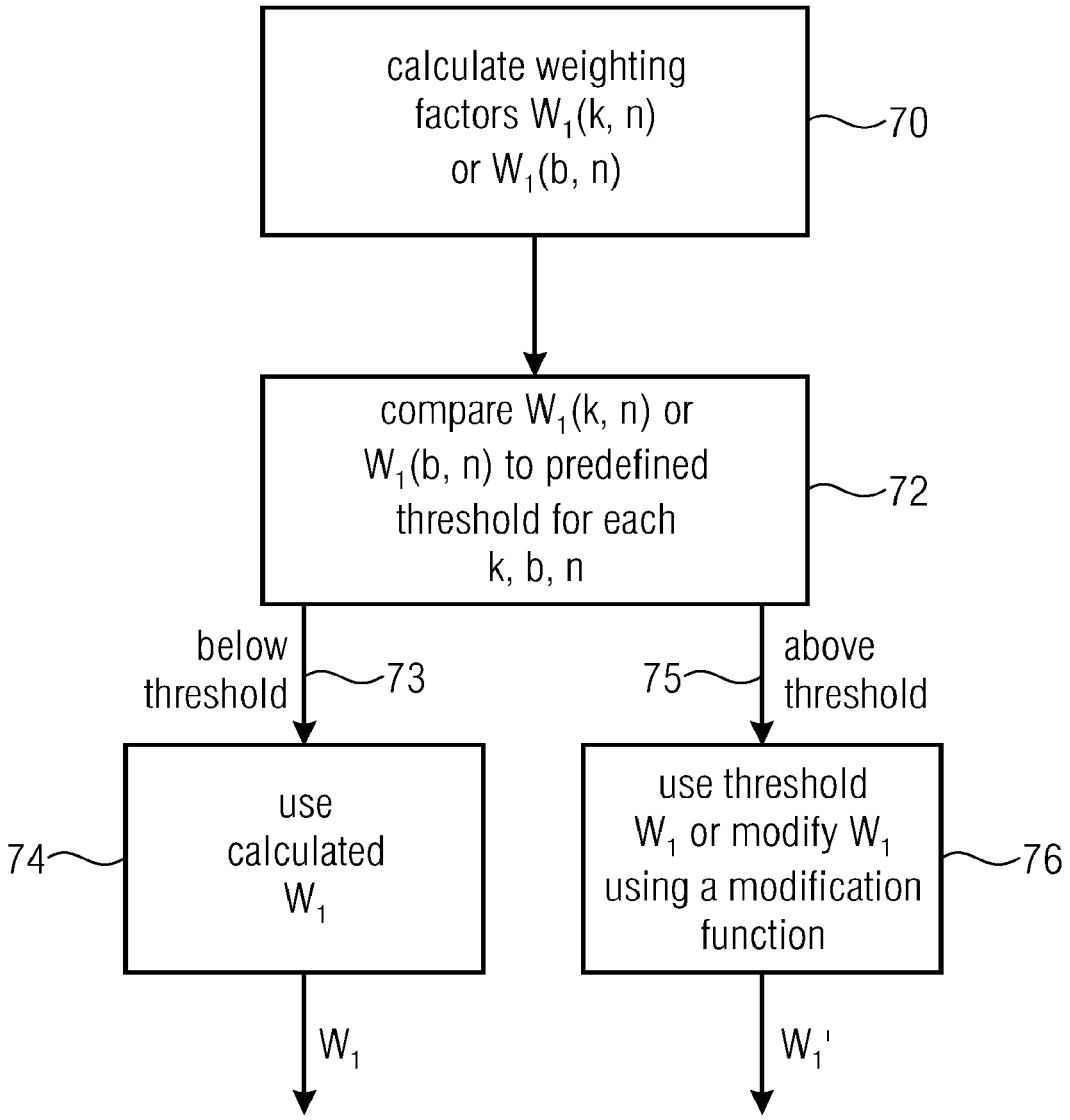
FIG. 4 illustrates an advantageous procedure implemented by the processor for processing the partial downmix signal.

In a further embodiment, the procedure in FIG. 4 is performed with respect to block 70 and block 76, but a comparison to a threshold as discussed with respect to block 72 is not performed. Subsequent to the calculation in block 70, a modified weighting factor is derived using the modification function of the above description of block 76, wherein the modification function is so that a modified weighting factor results in an energy of the partial downmix signal being smaller than an energy of the predefined energy relation. Advantageously, the modification function that is applied without a specific comparison is so that it limits, for high values of $W_1$ the manipulated or modified weighting factor to a certain limit or only has a very small increase such as a log or In function or so that, though not being limited to a certain value only has a very slow increase anymore so that stability problems as discussed before are substantially avoided or at least reduced.

In an advantageous embodiment illustrated in FIG. 8*a*-8*d*, the downmix is given by:

$$M[k,n]=W_1[k,n](L[k,n]+R[k,n])+W_2[k,n]L[k,n]$$

where $$W_1[k,\ n]=\frac{\sqrt{|L[k,\ n]|^2+|R[k,\ n]|^2}}{A(|L[k,\ n]|+|R[k,\ n]|)}$$

$$W_2[k,\ n]=\left(1-\frac{|L[k,\ n]+R[k,\ n]|}{|L[k,\ n]|+|R[k,\ n]|}\right)$$

In the above equation, A is a real valued constant advantageously being equal to the square root of 2, but A can have different values between 0.5 or 5 as well. Depending on the application, even values different from the above mentioned values can be used as well.

Given that $$|L[k,n]+R[k,n]|\leq|L[k,n]|+|R[k,n]|,$$

$W_1[k,n]$ and $W_2[k,n]$ are positive and $W_1[k,n]$ is limited to $$\frac{\sqrt{2}}{2A}$$

or e.g. 0.5.

The mixing gains can be computed bin-wise for each index k of the STFT as described in the previous formulas or can be computed band-wise for each non-overlapping sub-band gathering a set of indices b of the STFT. The gains are calculated based on the following equation:

$$W_1[b,n]=\frac{\sqrt{\sum_{k\in b}|L[k,n]|^2+\sum_{k\in b}|R[k,n]|^2}}{\sqrt{2}\left(\sum_{k\in b}|L[k,n]|+\sum_{k\in b}|R[k,n]|\right)}$$

$$W_2[b,n]=\left(1-\frac{\sum_{k\in b}|L[k,n]+R[k,n]|}{\sum_{k\in b}|L[k,n]|+\sum_{k\in b}|R[k,n]|}\right)$$

Since the energy preservation during the equalization is not a hard constraint, the energy of the resulting downmix signal varies compared the average energy of the input channel. The energy relation depends on the ILD and IPD as illustrated in FIG. 8*a*.

Figures 7A, 7B:
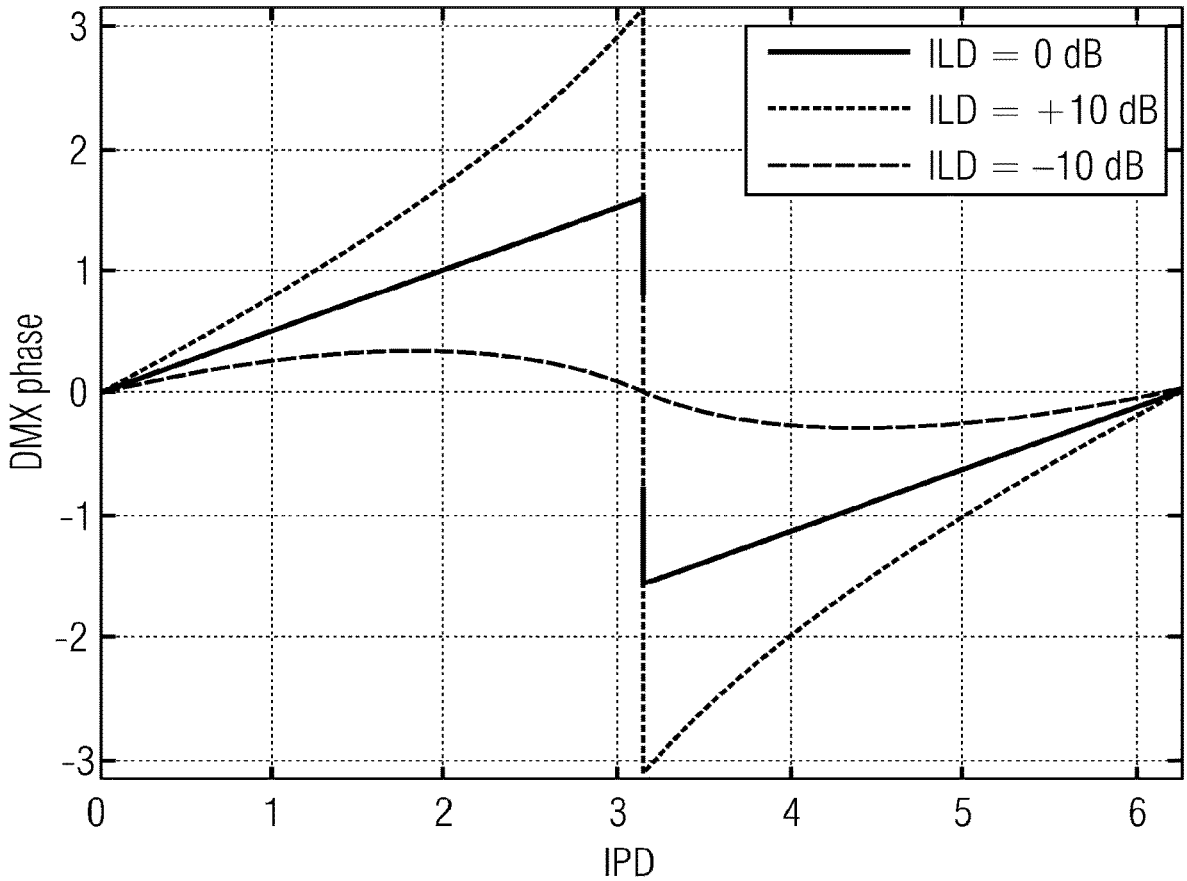
Fig. 7a (PRIOR ART)
Fig. 7b (PRIOR ART)
FIG. 7*a* illustrates the singularity point of the sum component in accordance with conventional technology.
FIG. 7*b* illustrates equations for calculating the downmix in the conventional-technology example of FIG. 7*a;*
Figure 8A:
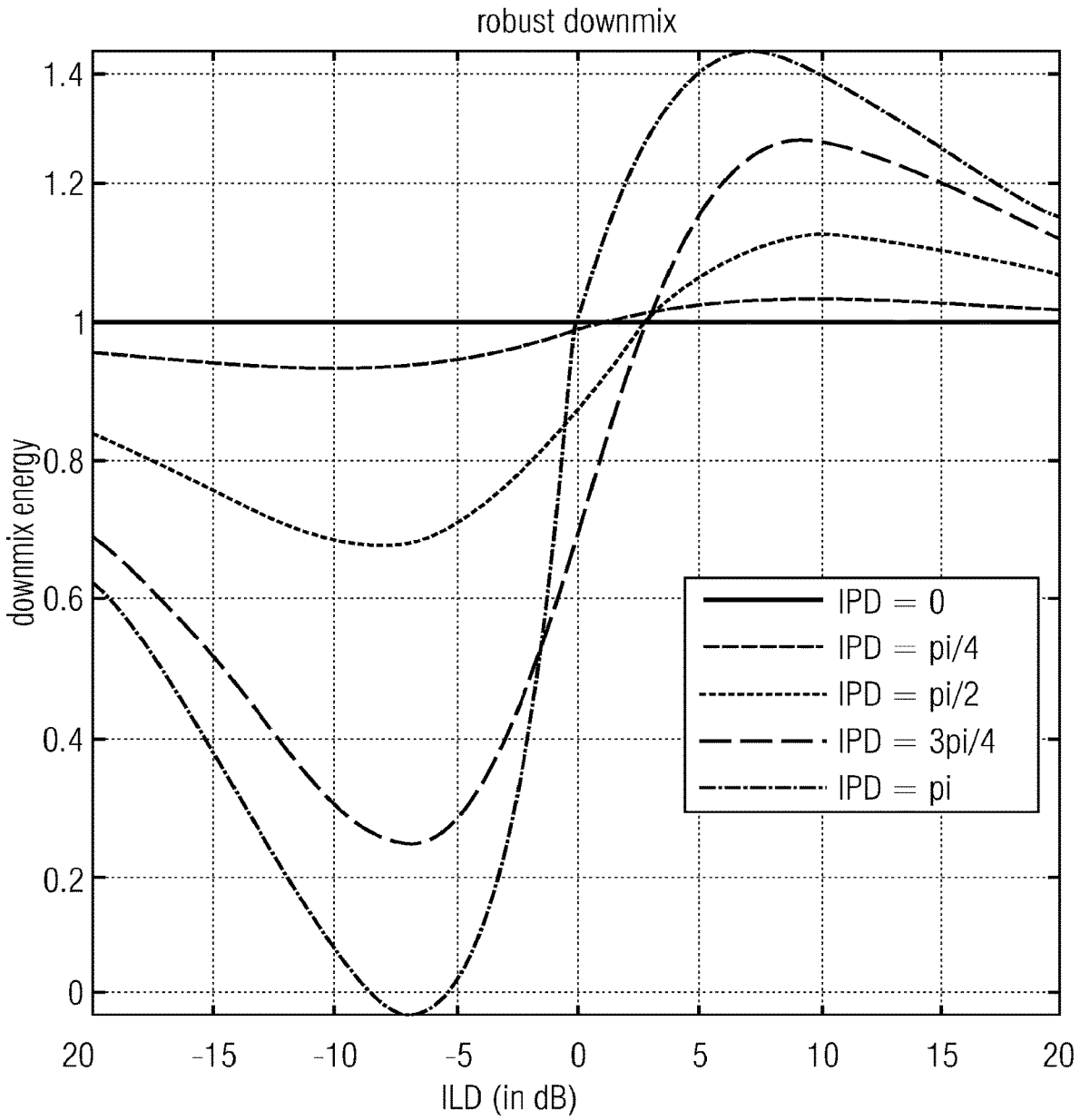
FIG. 8*a* illustrates an energy relation of a downmixing in accordance with an embodiment.
Figure 8D:
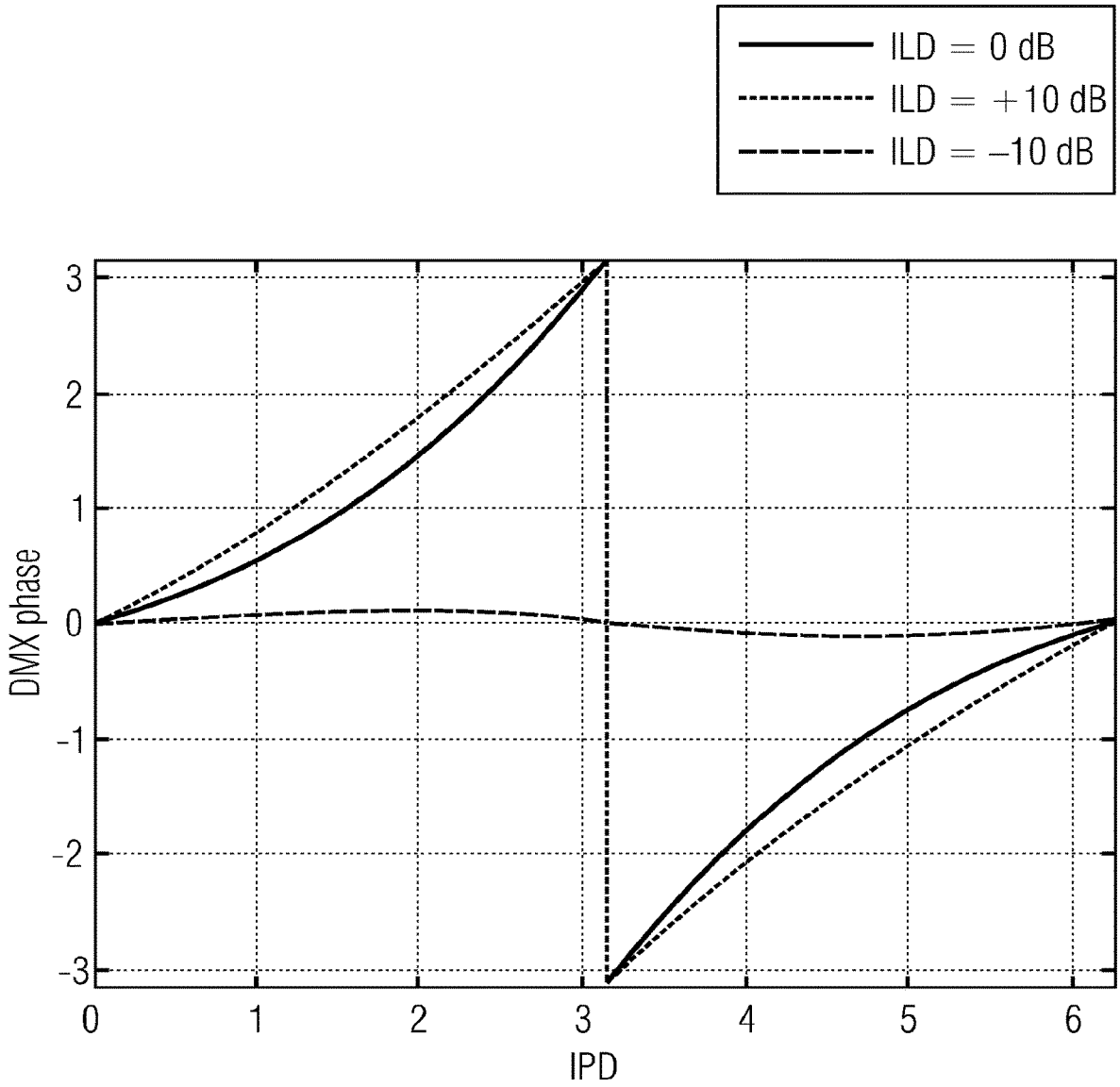
FIG. 8*d* illustrates the downmix phase for the FIG. 8*a* embodiment.

In contrast to the simple active downmixing method, which preserves a constant relation between the output energy and the average energy of the input channels, the new downmix signal does not show any singularity as illustrated in FIG. 8*d*. Indeed, in FIG. 7*a* a jump of a magnitude Pi (180°), can be observed at IP=Pi and ILD=0 dB, while in FIG. 8*d*, the jump is of 2Pi (360°), which corresponds to a continuous change in the unwrapped phase domain.

Listening test results confirm that the new down-mix method results in significantly less instabilities and impairments for a large range of stereo signals than conventional active downmixing.

In this context, FIG. 8*a* illustrates, along the x-axis, the inter-channel level difference between an original left and an original right channel in dB. Furthermore, the downmix energy is indicated in a relative scale between 0 and 1.4 along the y-axis and the parameter is the inter-channel phase difference IPD. Particularly, it appears that the energy of the resulting downmix signal varies particularly dependent on the phase between the channels and, for a phase of Pi (180°), i.e., for an out of phase situation, the energy variation is, at least for positive inter-channel level differences, in good shape. FIG. 8*b* illustrates equations for calculating the downmix signal M and it also becomes clear that, as the complementary signal, the left channel is selected. FIG. 8*c* illustrates weighting factors $W_1$ and $W_2$ not only for individual spectral indices, but for subbands where a set of indices from the STFT, i.e., at least two spectral values k are added together to obtain a certain sub-band.

Compared to the conventional technology illustrated in FIG. 7*a* and FIG. 7*b*, any singularity is not included anymore when FIG. 8*d* is compared to FIG. 7*a*.

FIG. 9*a*-9*f* illustrates a further embodiment, where the downmix is calculated using the difference between left and right signals L and R as the basis for the complementary signal. Particularly, in this embodiment.

$$M[k,n]=W_1[k,n](L[k,n]+R[k,n])+W_2[k,n](L[k,n]-R[k,n])$$

where the set of gains $W_1[k,n]$ and $W_2[k,n]$ are computed such that the energy relation between the down-mixed signal and the input channels holds in every condition.

First the gain $W_1[k,n]$ is computed for equalizing the energy till a given limit, where A is again a real valued number equal to $\sqrt{2}$ or different from this value:

$$x=\frac{1}{A}\left(\frac{\sqrt{|L[k,n]|^2+|R[k,n]|^2}}{\sqrt{|L+R|^2}}\right)$$

-continued $$W_1=\begin{cases} x & \text{if } x\le\frac{1}{\sqrt{2}} \\ \frac{1}{\sqrt{2}}+\left(1-\frac{1}{\sqrt{2}}\right)\left(1-\exp\left(\frac{\frac{1}{\sqrt{2}}-x}{1-\frac{1}{\sqrt{2}}}\right)\right) & \text{if } x>\frac{1}{\sqrt{2}} \end{cases}$$

Figures 9A, 9B:
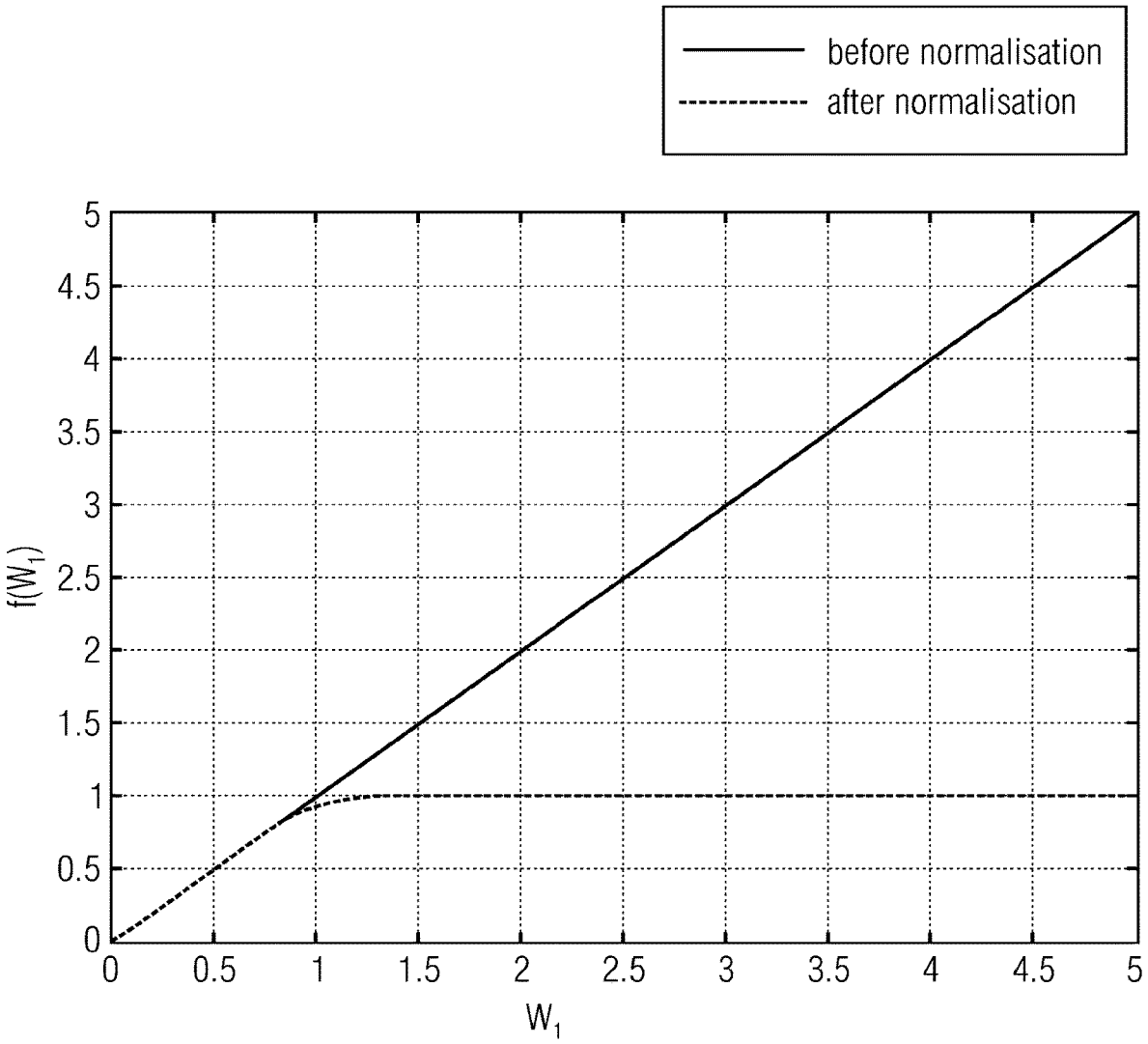
FIG. 9*a* illustrates a gain limitation chart for the sum signal in a further embodiment.
FIG. 9*b* illustrates an equation for calculating the downmix signal M for the embodiment of FIG. 9*a;*

As a consequence, the gain $W_1$ [k, n] of the sum signal is limited to the range [0, 1] as shown in FIG. 9*a*. In the equation for x, an alternative implementation is to use the denominator without a square root.

If the two channels have an IPD greater than pi/2, $W_1$ can no more compensate for the loss of energy, and it will be then coming from the gain $W_2$. $W_2$ is computed as one of the roots of the following quadratic equation:

$$E_M=|M|^2=|W_1(L+R)+W_2L|^2=\frac{L^2+R^2}{2}$$

The roots of the equation are given by:

$$W_2=-p+\sqrt{p_2-q},$$

where $$p=\frac{\langle W_1(L+R),L-R\rangle}{|L-R|^2}=\left(\frac{W_1(|L|^2-|R|^2)}{|L-R|^2}\right)$$

$$q=\frac{(W_1|L+R|)^2-\frac{|L|^2+|R|^2}{2}}{|L-R|^2}$$

Figure 9E:
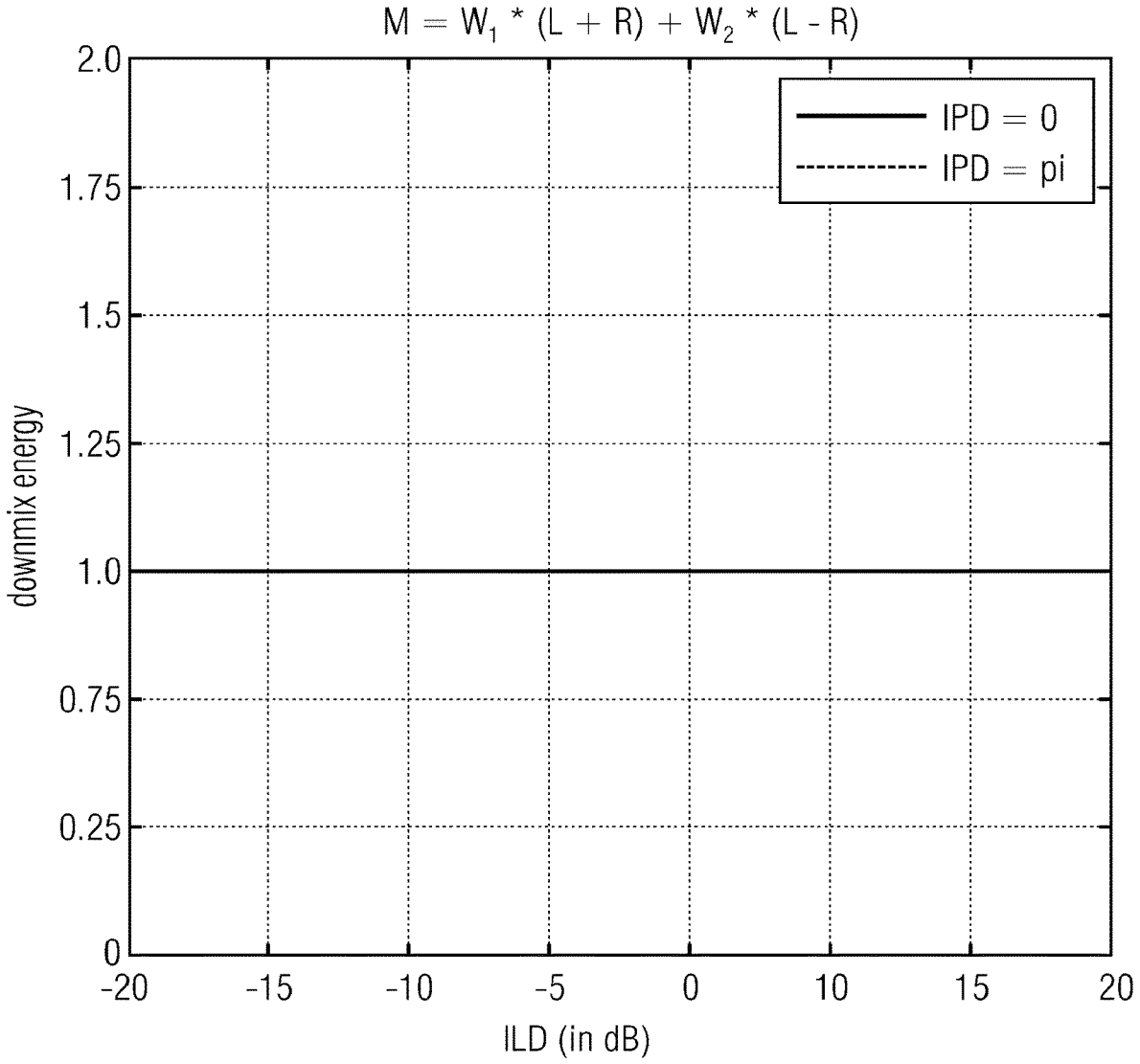
FIG. 9*e* illustrates an energy relation of the downmixing of FIG. 9*a*-9*d;*

One of the two roots can be then selected. For both roots, the energy relation is preserved for all conditions as shown in FIG. 9*e*.

If the two channels have an IPD greater than pi/2, $W_1$ can no more compensate for the loss of energy, and it will be then coming from the gain $W_2$. $W_2$ is computed as one of the roots of the following quadratic equation:

$$E_M=|M|^2=|W_1(L+R)+W_2L|^2=\frac{L^2+R^2}{2}$$

The roots of the equation are given by:

$$W_2=-p\pm\sqrt{p^2-q},$$

where $$p=\frac{\langle W_1(L+R),L-R\rangle}{|L-R|^2}=\left(\frac{W_1(|L|^2-|R|^2)}{|L-R|^2}\right)$$

$$q=\frac{(W_1|L+R|)^2-\frac{|L|^2+|R|^2}{2}}{|L-R|^2}$$

Figure 9F:
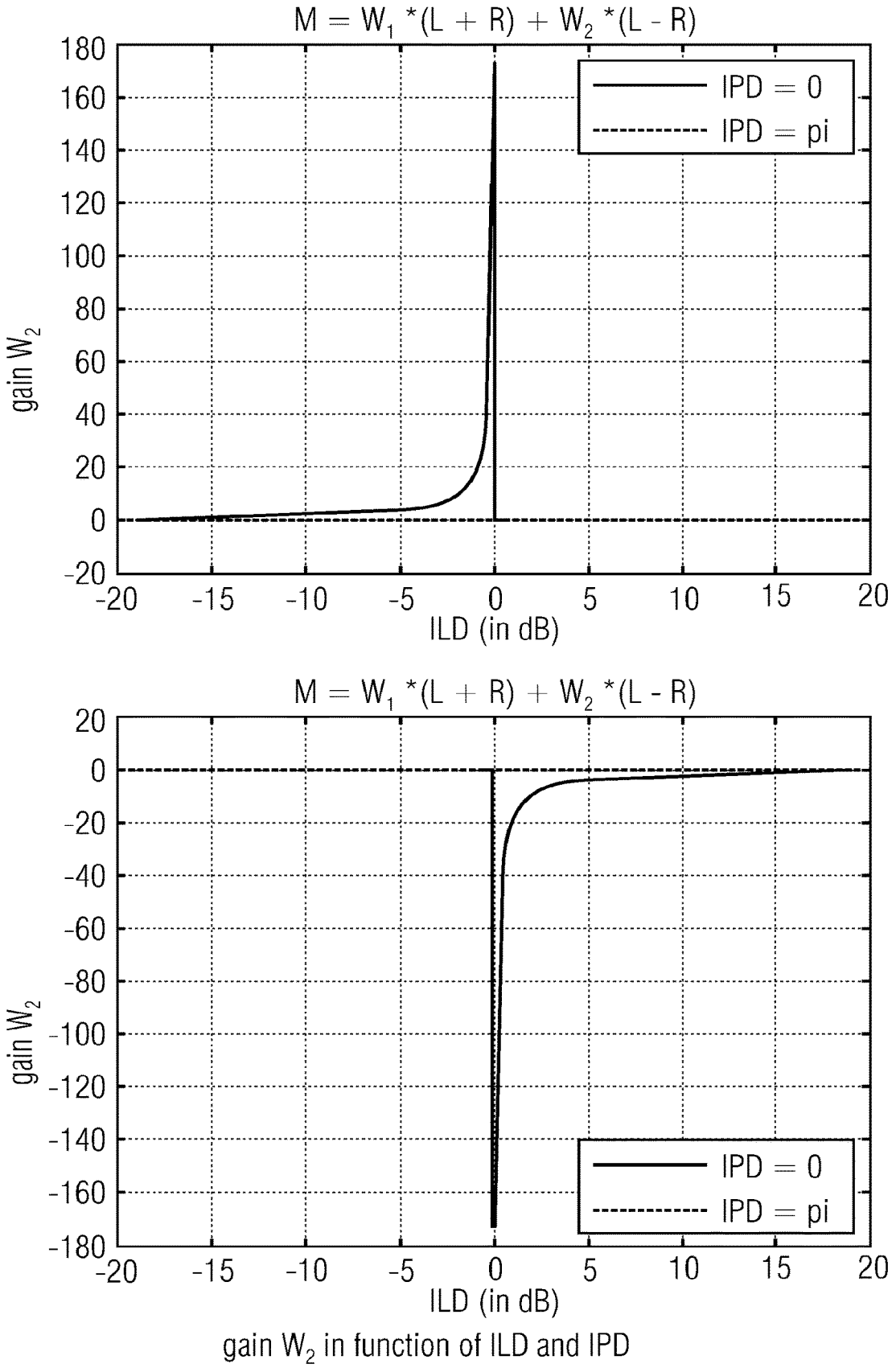
FIG. 9*f* illustrates the gain $W_2$ for the embodiment of FIGS. 9*a*-9*e;*

One of the two roots can be then selected. For both roots, the energy relation is preserved for all conditions as shown in FIG. 9*f*.

Advantageously, the root with the minimum absolute value is adaptively selected for $W_2[k,n]$.. Such an adaptive selection will result in a switch from one root to another for ILD=0 dB, which once again can create a discontinuity.

In contrast to the state-of-the art, this approach solves the comb-filtering effect of the downmix and spectral bias without introducing any singularity. It maintains the energy relations in all conditions but introduces more instabilities compared to the advantageous embodiment.

Thus, FIG. 9*a* illustrates a comparison of the gain limitation obtained by the factors $W_1$ of the sum signal in the calculation of the partial downmix signal of this embodiment. Particularly, the straight line is the situation before normalization or before modification of the value as discussed before with respect to block 76 of FIG. 4. And, the other line that approaches a value of 1 for the modification function as a function of the weighting factor $W_1$. It becomes clear that an influence of the modification function occurs at values above 0.5 but the deviation only becomes really visible for values $W_1$ of about 0.8 and greater.

FIG. 9*b* illustrates the equation implemented by the FIG. 1 block diagram for this embodiment.

Furthermore, FIG. 9*c* illustrates how the values $W_1$ are calculated and, therefore, FIG. 9*a* illustrates the functional situation of FIG. 9*c*. Finally. FIG. 9*d* illustrates the calculation of $W_2$, i.e., the weighting factors used by the complementary signal generator 20 of FIG. 1.

FIG. 9*e* illustrates that the downmix energy is the same and equal to 1 for all phase differences between the first and the second channels and for all level differences ALD between the first and the second channels.

However, FIG. 9*f* illustrates the discontinuities incurred by the calculations of the rules of the equation for Eu of FIG. 9*d* due to the fact there is a denominator in the equation for p and the equation for q illustrated in FIG. 9*d* that can become 0.

FIGS. 10*a*-10*e* illustrate a further embodiment that can be seen as a compromise between the two earlier described alternatives.

The downmixing is given by;

$$M=W_1[k](L[k]+R[k])+W_2[k](L[k]-R[k])$$

Where $$x=\frac{1}{A}\left(\frac{\sqrt{|L[k,n]|^2+|R[k,n]|^2}}{\sqrt{(L+R)^2}}\right)$$

$$W_1=\begin{cases} x & \text{if } x\le\frac{1}{\sqrt{2}} \\ \frac{1}{\sqrt{2}}+\left(1-\frac{1}{\sqrt{2}}\right)\left(1-\exp\left(\frac{\frac{1}{\sqrt{2}}-x}{1-\frac{1}{\sqrt{2}}}\right)\right) & \text{if } x>\frac{1}{\sqrt{2}} \end{cases}$$

In the equation for x, an alternative implementation is to use the denominator without a square root.

In this case the quadratic equation to solve is:

$$E_M=|M|^2=|W_1(L+R)+W_2L|^2=\left(\frac{|L|+|R|}{2}\right)^2$$

This time the gain $W_2$ is not exactly taken as one of the roots of the quadratic equation but rather:

$$W_2=-|p|+\sqrt{p^2-q}$$

where $$p=\frac{\langle W_1(L+R),L-R\rangle}{|L-R|^2}=\left(\frac{W_1(|L|^2-|R|^2)}{|L-R|^2}\right)$$

$$q=\frac{(W_1|L+R|)^2-\left(\frac{|L|+|R|}{2}\right)^2}{|L-R|^2}$$

Figure 10A:
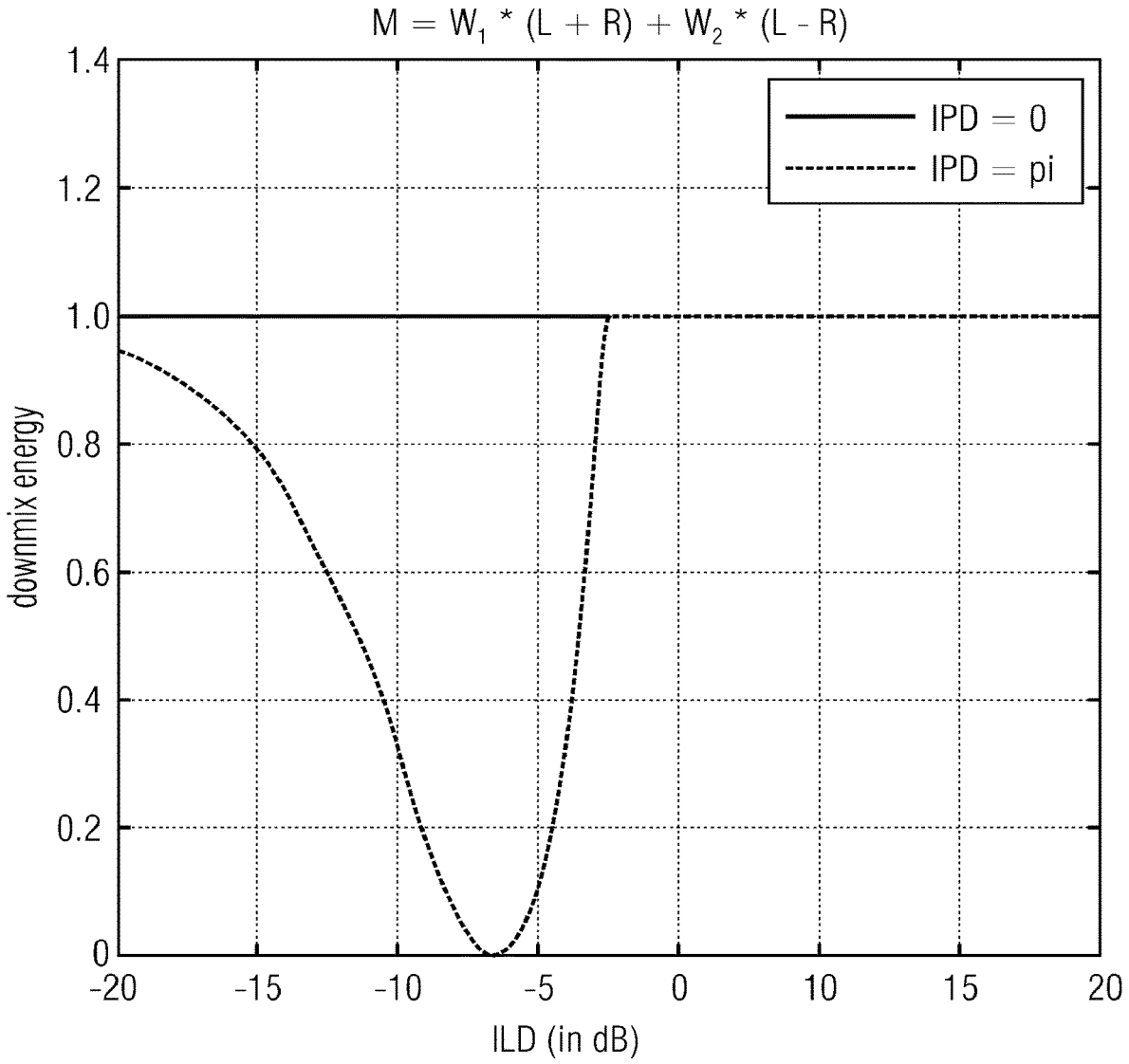
FIG. 10*a* illustrates a downmix energy for a further embodiment.

As a result, the energy relation is not preserved all the time as shown in FIG. 10*a*. On the other hand the gain $W_2$ doesn't show any discontinuities in FIG. 10*e* and compared to the second embodiment instability problems are reduced.

Thus, FIG. 10*a* illustrates the energy relation of this embodiment illustrated by FIGS. 10*a*-10*e* where, once again, the downmix energy is illustrated at the y-axis and the inter-channel level difference is illustrated at the x-axis. FIG. 10*b* illustrates the equations applied by FIG. 1 and the procedures performed for calculating the first weighting factors $W_1$ as illustrated with respect to block 76. Furthermore, FIG. 10*c* illustrates the alternative calculation of $W_2$ with respect to the embodiment of FIG. 9*a*-9*f*. Particularly, p is subjected to an absolute value function which appears when comparing FIG. 10*c* to the similar equation in FIG. 9*d*.

FIG. 10*d* then once again shows the calculation of p and q and FIG. 10*d* roughly corresponds to the equations in FIG. 10*d* at the bottom.

Figure 10E:
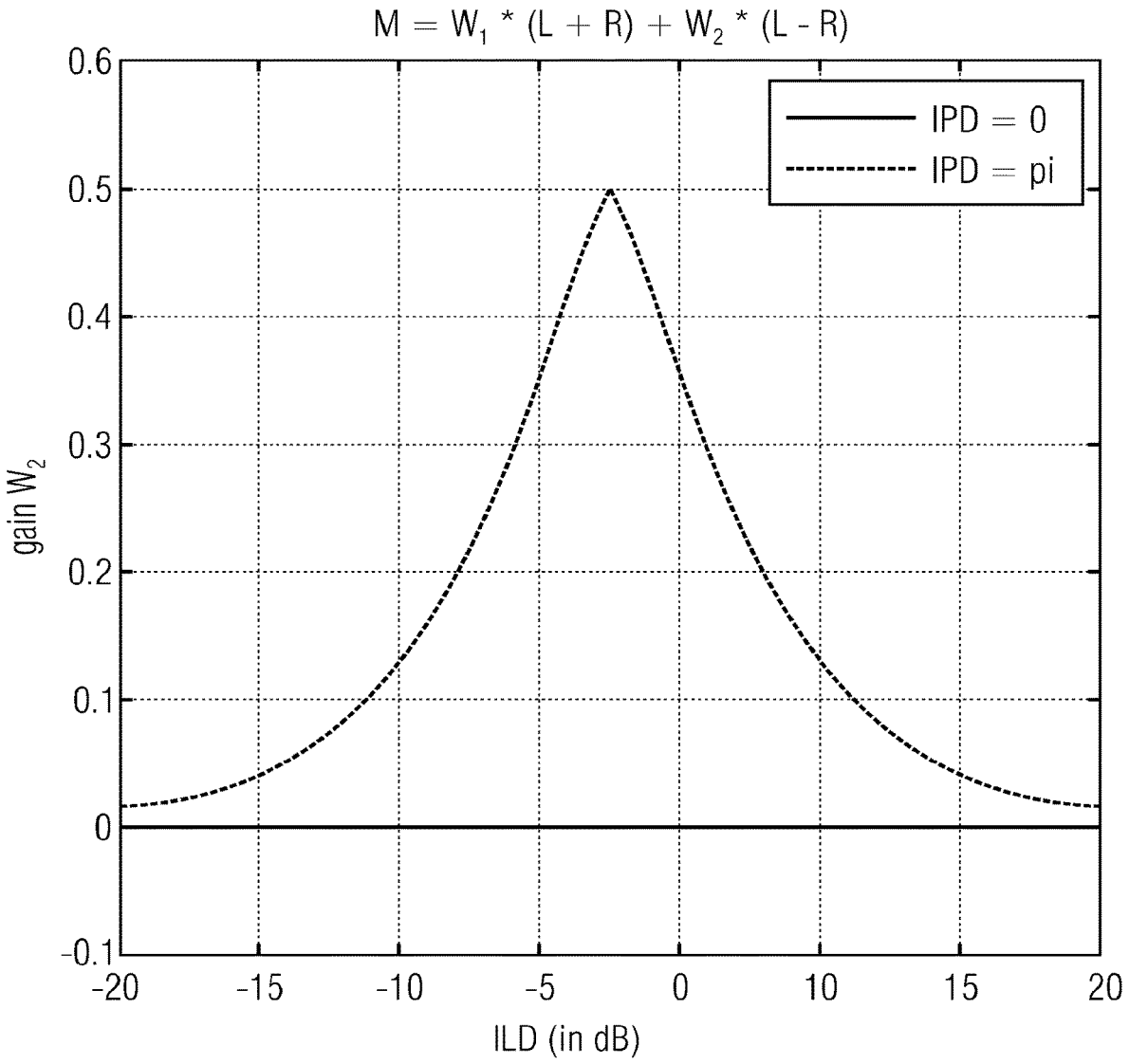
FIG. 10*e* illustrates the gain $W_2$ as function of ILD and IPD of the downmixing with respect to the embodiment illustrated in FIG. 10*a* to 10*d*.

FIG. 10*e* illustrates the energy relation of this new downmixing in accordance with the embodiment illustrated in FIG. 10*a*-10*d*, and it appears that the gain $W_2$ only approaches a maximum value of 0.5.

Although the preceding description and certain FIGS. provide detailed equations, it is to be noted that advantages are already obtained even when the equations are not calculated exactly, but when the equations are calculated, but the results are modified. Particularly, the functionalities of the first weighting factor calculator 15 and the second weighting factor calculator 24 of FIG. 3 are performed so that the first weighting factors or the second weighting factors have values being in a range of ±20% of values determined based on the above given equations. In the advantageous embodiment, the weighting factors are determined to have values being in a range of ±10% of the values determined by the above equations. In even more advantageous embodiments, the deviation is only ±1% and in the most advantageous embodiments, the results of the equations are exactly taken. But, as stated, advantages of the present invention are even obtained, when deviations of ±20% from the above described equations are applied.

Figure 5:
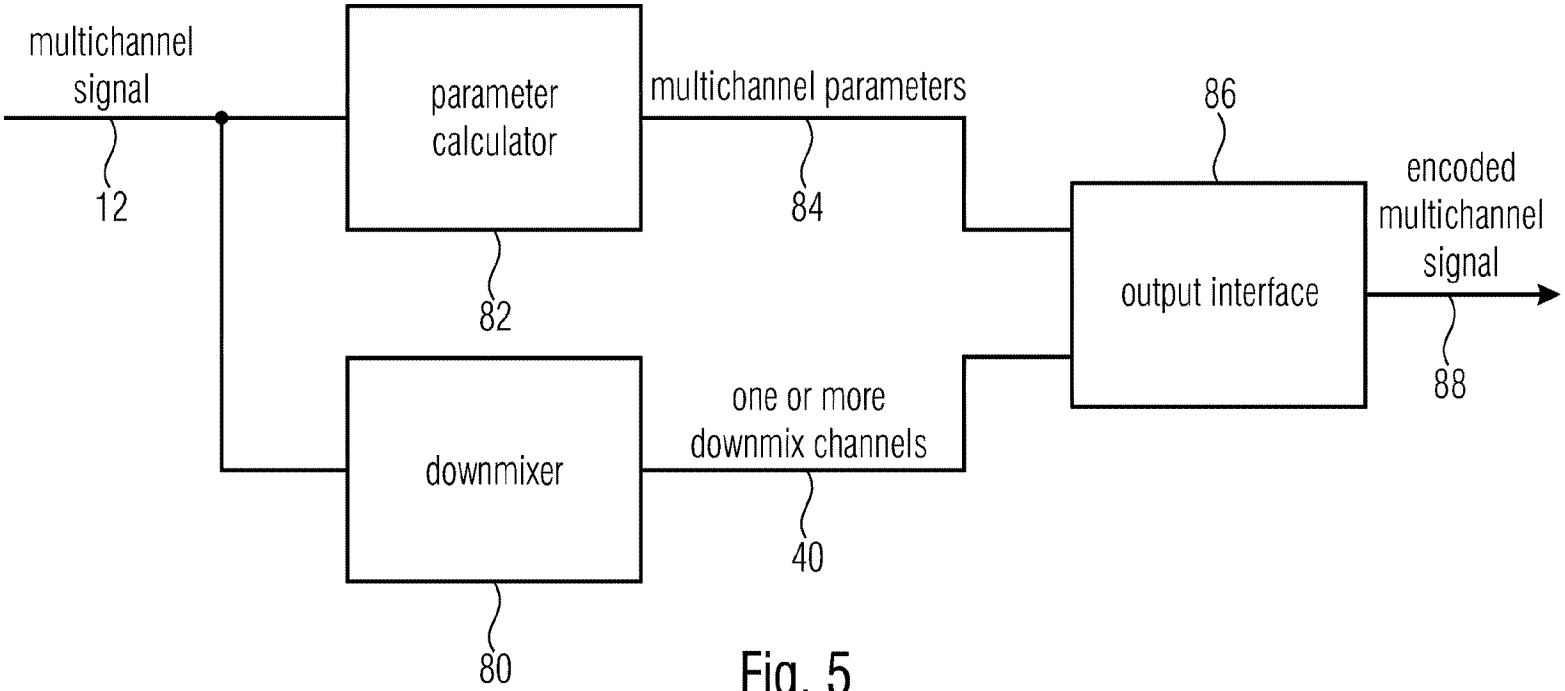
FIG. 5 illustrates a block diagram of a multichannel encoder in an embodiment.
Figure 6:
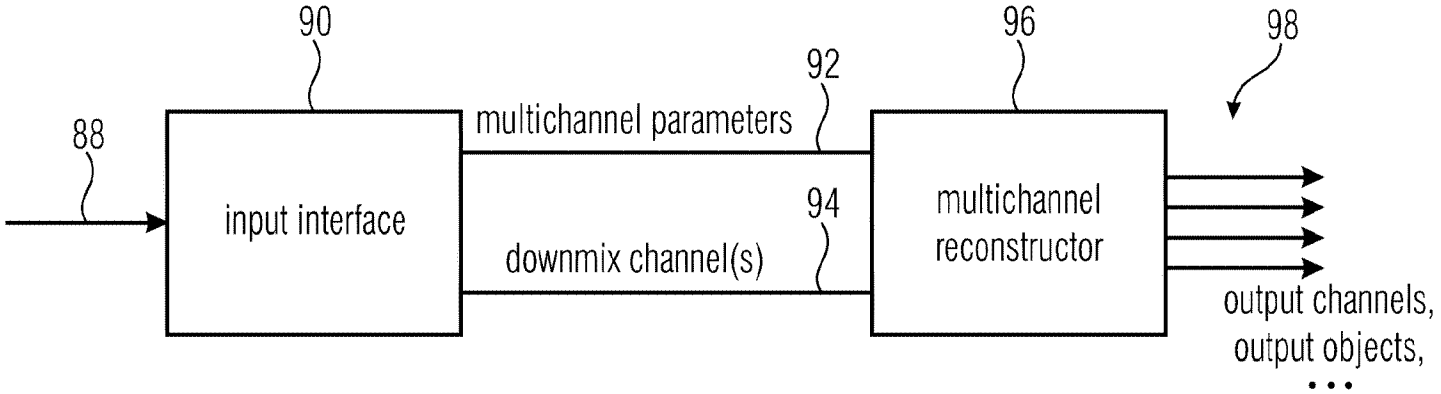
FIG. 6 illustrates a block diagram of a multichannel decoder.

FIG. 5 illustrates an embodiment of a multichannel encoder, in which the inventive downmixer as discussed before with respect to FIGS. 1-4, 8*a*-10*e* can be used. Particularly, the multichannel encoder comprises a parameter calculator 82 for calculating multichannel parameters 84 from at least two channels of the multichannel signal 12 having the two or more channels. Furthermore, the multichannel encoder comprises the downmixer 80 that can be implemented as discussed before and that provides one or more downmix channels 40. Both, the multichannel parameters 84 and the one or more downmix channels 40 are input into an output interface 86 for outputting an encoded multichannel signal comprising the one or more downmix channels and/or the multichannel parameters. Alternatively, the output interface can be configured for storing or transmitting the encoded multichannel signal to, for example, a multichannel decoder illustrated in FIG. 6. The multichannel decoder illustrated in FIG. 6 receives, as an input, the encoded multichannel signal 88. This signal is input into an input interface 90, and the input interface 90 outputs, on the first hand, the multichannel parameters 92 and, on the other hand, the one or more downmix channels 94. Both data items, i.e., the multichannel parameters 92 and downmix channels 94 are input into a multichannel reconstructor 96 that reconstructs, at its output, an approximation of the original input channels and, in general, outputs output channels that may comprise or consist of output audio objects or anything like that as indicated by reference numeral 98. Particularly, the multichannel encoder in FIG. 5 and the multichannel decoder in FIG. 6 together represent an audio processing system where the multichannel encoder is operative as discussed with respect to FIG. 5 and where the multichannel decoder is, for example, implemented as illustrated in FIG. 6 and is, in general, configured for decoding the encoded multichannel signal to obtain a reconstructed audio signal illustrated at 98 in FIG. 6. Thus, the procedures illustrated with respect to FIG. 5 and FIG. 6 additionally represent a method of processing an audio signal comprising a method of multichannel encoding and a corresponding method of multichannel decoding.

An inventively encoded audio signal can be stored on a digital storage medium or a non-transitory storage medium or can be transmitted on a transmission medium such as a wire-less transmission medium or a wired transmission medium such as the Internet.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and com-positions of the present invention. It is therefore intended that the following appended claims be interpreted as including all such alterations, permutations and equivalents as fall within the true spirit and scope of the present invention.

REFERENCES

[1] U.S. Pat. No. 7,343,281 B2, "PROCESSING OF MULTI-CHANNEL SIGNALS", Koninklijke Philips Electronics N. V., Eindhoven (NL)

[2] Samsudin, E. Kumiawati, Ng Boon Poh, F. Sattar, and S. George, "A Stereo to Mono Downmixing Scheme for MPEG-4 Parametric Stereo Encoder," in IEEE International Conference on Acoustics, Speech and Signal Processing, vol. 5, 2006, pp. 529-532.

[3] T. M. N. Hoang, S. Ragot, B. Kövesi, and P. Scalart, "Parametric Stereo Extension of ITU-T G. 722 Based on a New Downmixing Scheme," IEEE International Workshop on Multimedia Signal Processing (MMSP) (2010).

[4] W. Wu, L. Miao, Y. Lang, and D. Virette, "Parametric Stereo Coding Scheme with a New Downmix Method and Whole Band Inter Channel Time/Phase Differences," in IEEE International Conference on Acoustics, Speech and Signal Processing, 2013, pp. 556-560.

[5] Alexander Adami, Emanuël A. P. Habets, Jürgen Herre, "DOWN-MIXING USING COHERENCE SUPPRESSION", 2014 IEEE International Conference on Acoustic, Speech and Signal Processing (ICASSP)

[6] Vilkamo, Juha; Kuntz, Achim; Füg, Simone, "Reduction of Spectral Artifacts in Multi-channel Downmixing with Adaptive Phase Alignment", AES Aug. 22, 2014

The invention claimed is:

1. A downmixer for downmixing at least two channels of a multichannel signal comprising two or more channels, comprising:

a processor for calculating a partial downmix signal from the at least two channels using adding the two or more channels;

a complementary signal calculator for calculating a complementary signal from the multichannel signal, the complementary signal being different from the partial downmix signal; and an adder for adding the partial downmix signal and the complementary signal to acquire a downmix signal of the multichannel signal.

2. The downmixer of claim 1, wherein the processor is configured to calculate the partial downmix signal so that a predefined energy or amplitude relation between the at least two channels of the multichannel signal and the partial downmix signal is fulfilled, when the at least two channels are in phase and so that an energy loss is created in the partial downmix signal with respect to the at least two channels, when the at least two channels are out of phase, and wherein the complementary signal calculator is configured to calculate the complementary signal so that the energy or amplitude loss of the partial downmix signal is partly or fully compensated by the adding of the partial downmix signal and the complementary signal in the adder.

3. The downmixer of claim 1, wherein the complementary signal calculator is configured to calculate the complementary signal so that the complementary signal comprises a coherence index of less than 0.7 with respect to the partial downmix signal, wherein a coherence index of 0.0 shows a full incoherence and a coherence index of 1.0 shows a full coherence.

4. The downmixer of claim 1, wherein the complementary signal calculator is configured to use, for calculating the complementary signal, one signal of the following groups of signals comprising a first channel of the at least two channels, a second channel of the at least two channels, a difference between the first channel and the second channel, a difference between the second channel and the first channel, a further channel of the multichannel signal, when the multichannel signal comprises more channels than the at least two channels, or a decorrelated first channel, a decorrelated second channel, a decorrelated further channel, a decorrelated difference involving the first channel and the second channel or a decorrelated partial downmix signal.

5. The downmixer of claim 1, wherein the processor is configured for:

calculating time or frequency-dependent weighting factors for weighting a sum of the at least two channels in accordance with a predefined energy or amplitude relation between the at least two channels and a sum signal of the at least two channels; and comparing a calculated weighting factor to a predefined threshold; and using the calculated weighting factor for calculating the partial downmix signal, when the calculated weighting factor is in a first relation to the predefined threshold, or when the calculated weighting factor is in a second relation to the predefined threshold being different from the first relation, using the predefined threshold instead of the calculated weighting factor for calculating the partial downmix signal, or when the calculated weighting factor is in a second relation to the predefined threshold being different from the first relation, deriving a modified weighting factor using a modification function, wherein the modification function is so that the modified weighting factor is closer to the predefined threshold than the calculated weighting factor.

6. The downmixer of claim 1, wherein the processor is configured for:

calculating time or frequency-dependent weighting factors for weighting a sum of the at least two channels in accordance with a predefined energy or amplitude relation between the at least two channels and a sum signal of the at least two channels; and deriving a modified weighting factor using a modification function, wherein the modification function is so that the modified weighting factor results in an energy of the partial downmix signal being smaller than an energy as defined by the predefined energy relation.

7. The downmixer of claim 1, wherein the processor is configured to weight as sum signal of the at least two channels using time or frequency-dependent weighting factors, wherein the weighting factors $W_1$ are calculated so that the weighting factors comprise values being in a range of ±20% of values determined based on the following equation for a frequency bin k and a time index n:

$$W_1[k, n] = \frac{\sqrt{|L[k, n]|^2 + |R[k, n]|^2}}{A(|L[k, n]| + |R[k, n]|)},$$

for a subband b and a time index n:

$$W_1[b, n] = \frac{\sqrt{\sum_{k\in b} |L[k, n]|^2 + \sum_{k\in b} |R[k, n]|^2}}{A\left(\sum_{k\in b} |L[k, n]| + \sum_{k\in b} |R[k, n]|\right)},$$

wherein A is a real valued constant, wherein L represents a first channel of the at least two channels and R represents a second channel of the at least two channels of the multichannel signal.

8. The downmixer of claim 1, wherein the complementary signal calculator is configured to use one channel of the at least two channels and to weight the used channel using time or frequency dependent complementary weighting factors $W_2$, wherein the complementary weighting factors $W_2$ are calculated so that the complementary weighting factors comprise values being in a range of ±20% of values determined based on the following equation for a frequency bin k and a time index n:

$$W_2[k, n] = \left(1 - \frac{|L[k, n] + R[k, n]|}{|L[k, n]| + |R[k, n]|}\right),$$

for a subband b and a time index n:

$$W_2[b, n] = \left(1 - \frac{\sum_{k\in b} |L[k, n] + R[k, n]|}{\sum_{k\in b} |L[k, n]| + \sum_{k\in b} |R[k, n]|}\right),$$

wherein L represents a first channel of the two or more channels and R represents a second channel of the two or more channels of the multichannel signal.

9. The downmixer of claim 1, wherein the complementary signal calculator is configured to use a difference between a first channel of the two or more channels and a second channel of the two or more channels of the multichannel signal and to weight the difference using time and frequency dependent complementary weighting factors, wherein the complementary weighting factors are calculated so that the complementary weighting factors comprise values being in the range of ±20% of values determined based on the following equations:

$$W_2=-p\pm\sqrt{p_2-q}$$

where $$p=\frac{\langle W_1(L+R),\ L-R\rangle}{|L-R|^2}=\left(\frac{W_1(|L|^2-|R|^2)}{|L-R|^2}\right)$$

$$q=\frac{(W_1|L+R|)^2-\frac{|L|^2+|R|^2}{2}}{|L-R|^2}$$

wherein L is the first channel of the two or more channels and R is the second channel of the two or more channels of the multichannel signal.

10. The downmixer of claim 1, wherein the complementary signal calculator is configured to use a difference between a first channel of the two or more channels and a second channel of the two or more channels of the multichannel signal and to weight the difference using time and frequency dependent complementary weighting factors, wherein the complementary weighting factors are calculated so that the complementary weighting factors comprise values being in the range of ±20% of values determined based on the following equations:

$$W_2=-|p|+\sqrt{p^2-q}$$

where $$p=\frac{\langle W_1(L+R),\ L-R\rangle}{|L-R|^2}=\left(\frac{W_1(|L|^2-|R|^2)}{|L-R|^2}\right)$$

$$q=\frac{(W_1|L+R|)^2-\frac{|L|^2+|R|^2}{2}}{|L-R|^2}$$

wherein L is the first channel of the two or more channels and R is the second channel of the two or more channels of the multichannel signal.

11. The downmixer of claim 1, wherein the processor is configured:

to calculate a sum signal from the at least two channels;

to calculate weighting factors for weighting the sum signal in accordance with a predetermined relation between the sum signal and the at least two channels;

to modify calculated weighting factors being higher than a predefined threshold, and to apply the modified weighting factors for weighting the sum signal to acquire the partial downmix signal.

12. The downmixer of claim 1, wherein the processor is configured to modify the calculated weighting factors to be in a range of ±20% of the predefined threshold, or to modify the calculated weighting factors so that the calculated weighting factors comprise values being in a range of ±20% of values determined based on the following equations:

$$W_1=\begin{cases} x & \text{if } x\le\frac{1}{\sqrt{2}} \\ \frac{1}{\sqrt{2}}+\left(1-\frac{1}{\sqrt{2}}\right)\left(1-\exp\left(\frac{\frac{1}{\sqrt{2}}-x}{1-\frac{1}{\sqrt{2}}}\right)\right) & \text{if } x>\frac{1}{\sqrt{2}} \end{cases}$$

wherein $$x=\frac{1}{A}\left(\frac{\sqrt{|L[k,n]|^2+|R[k,n]|^2}}{\sqrt{|L+R|^2}}\right)$$

wherein A is a real valued constant, L is a first channel of the two or more channels and R is a second channel of the two or more channels of the multichannel signal.

13. A method for downmixing at least two channels of a multichannel signal comprising two or more channels, comprising:

calculating a partial downmix signal from the at least two channels using adding the two or more channels;

calculating a complementary signal from the multichannel signal, the complementary signal being different from the partial downmix signal; and adding the partial downmix signal and the complementary signal to acquire a downmix signal of the multichannel signal.

14. A multichannel encoder, comprising:

a parameter calculator for calculating multichannel parameters from at least two channels of a multichannel signal comprising the two or more than two channels, and a downmixer of claim 1; and an output interface for outputting or storing an encoded multichannel signal comprising one or more downmix signals and/or the multichannel parameters.

15. A method for encoding a multichannel signal, comprising:

calculating multichannel parameters from at least two channels of a multichannel signal comprising two or more than two channels;

downmixing in accordance with the method of claim 13; and outputting or storing an encoded multichannel signal comprising the one or more downmix signals and the multichannel parameters.

16. A non-transitory digital storage medium having a computer program stored thereon to perform the method for downmixing at least two channels of a multichannel signal comprising two or more channels, comprising:

calculating a partial downmix signal from the at least two channels using adding the two or more channels;

calculating a complementary signal from the multichannel signal, the complementary signal being different from the partial downmix signal; and adding the partial downmix signal and the complementary signal to acquire a downmix signal of the multichannel signal, when said computer program is run by a computer.

17. A non-transitory digital storage medium having a computer program stored thereon to perform the method for encoding a multichannel signal, comprising:

calculating multichannel parameters from at least two channels of a multichannel signal comprising two or more than two channels;

downmixing in accordance with the method as claimed in claim 13; and outputting or storing an encoded multichannel signal comprising one or more downmix signals and the multichannel parameters, when said computer program is run by a computer.

* * * * *